US005683793A

United States Patent [19]

Malhotra et al.

[11] Patent Number: 5,683,793

[45] Date of Patent: Nov. 4, 1997

[54] INK JET TRANSPARENCIES

[75] Inventors: Shadi L. Malhotra; Kirit N. Naik, both of Mississauga; David N. MacKinnon, Etobicoke; Arthur Y. Jones, Mississauga, all of Canada

[73] Assignee: Xerox Corporation, Stamford, Conn.

[21] Appl. No.: 657,134

[22] Filed: Jun. 3, 1996

[51] Int. Cl.[6] ..... B41M 5/00

[52] U.S. Cl. ..... 428/216; 428/195; 428/206; 428/323; 428/325; 428/327; 428/331

[58] Field of Search ..... 347/105; 428/195, 428/206, 216, 323, 325, 327, 331, 480, 500, 520

[56] References Cited

U.S. PATENT DOCUMENTS 4,956,225 9/1990 Malhotra ..... 428/216
4,997,697 3/1991 Malhotra ..... 428/195
5,118,570 6/1992 Malhotra ..... 428/474.4
5,202,205 4/1993 Malhotra ..... 430/17
5,212,008 5/1993 Malhotra et al. ..... 428/216

*Primary Examiner*—Bruce H. Hess
*Attorney, Agent, or Firm*—E. O. Palazzo

[57] ABSTRACT

A transparency comprised of a supporting substrate, thereover a first coating layer comprised of an ink absorbing layer and a biocide; and a second ink spreading coating layer comprised of a hydrophilic vinyl binder, a dye mordant, a filler, an optional lightfastness inducing agent, and an ink spot size increasing agent selected from the group consisting of hydroxy acids, amino acids and polycarboxyl compounds; and wherein the first coating is in contact with the substrate and is situated between the substrate and the second ink coating, and which transparency possesses a haze value of from about 0.5 to about 10 and a lightfastness value of from about 95 to about 98.

31 Claims, No Drawings

INK JET TRANSPARENCIES

BACKGROUND OF THE INVENTION

The present invention is directed to transparencies, and more specifically, to low haze lightfast, waterfast ink jet transparencies having improved ink absorption and ink spreading when used in combination with slow drying black and fast drying colored, other than black, inks. In embodiments of the present invention, the transparencies are comprised of a supporting substrate and thereover two coatings, a first super ink absorbent binder polymer that adheres well to the substrate, such as a polyacrylate salt or the copolymer thereof such as acrylic acid-acrylamide copolymer, and a second vinyl polymer, such as a polyvinyl alcohol ink spreading layer containing ink/transparency compatibilizer and lightfastness inducing compounds, such as hydroxy acids, amino acids, and polycarboxylic compounds, and waterfastness inducing dye mordants, such as cationic quaternary compounds, and preferably wherein two coatings are present on each surface of the supporting substrate. With the transparencies of the present invention, there are enabled a number of advantages, including the important advantage of low haze, that is, for example, wherein the transparencies permit 95 percent of the light to be transmitted therethrough in embodiments, and which transparencies possess excellent lightfastness and waterfastness characteristics. The transparencies of the present invention can be selected for ink jet methods and apparatus, which employ slow drying inks of one color and fast drying inks of another color in order to reduce intercolor bleed. Different solvent vehicles can be used to produce slow drying inks of one color and fast drying inks of another color which necessitates developing transparencies with special surfaces to accommodate these variable ink compositions.

U.S. Pat. No. 5,118,570 and U.S. Pat. No. 5,006,407, the disclosures of each of which are totally incorporated herein by reference, disclose a transparency which comprises a hydrophilic coating and a plasticizer, which plasticizer can, for example, be from the group consisting of phosphates, substituted phthalic anhydrides, glycerols, glycols, substituted glycerols, pyrrolidinones, alkylene carbonates, sulfolanes, and stearic acid derivatives.

U.S. Pat. No. 4,526,847 discloses a transparency for the formation of an adherent electrostatic image thereon which includes a polyester resin film sheet having an image-receiving coating of nitrocellulose, a plasticizer, a particulate material, and preferably an antistatic agent. The coating is applied to the film sheet from a solvent mixture of an aliphatic ester or an aliphatic ketone, and an aliphatic alcohol.

U.S. Pat. No. 4,956,225 discloses a transparency suitable for electrographic and xerographic imaging which comprises a polymeric substrate with a toner receptive coating on one surface thereof comprising blends selected from the group consisting of poly(ethylene oxide) and carboxymethyl cellulose; poly(ethylene oxide), carboxymethyl cellulose, and hydroxypropyl cellulose; poly(ethylene oxide) and vinylidene fluoride/hexafluoropropylene copolymer; poly (chloroprene) and poly(alpha-methylstyrene); poly (caprolactone) and poly(alpha-methylstyrene); poly(vinyl isobutyl ether) and poly(alpha-methylstyrene); poly (caprolactone) and poly(p-isopropyl alpha-methylstyrene); blends of poly(1,4-butylene adipate) and poly(alpha-methylstyrene); chlorinated poly(propylene) and poly (alpha-methylstyrene); chlorinated poly(ethylene) and poly (alpha-methylstyrene); and chlorinated rubber and poly (alpha-methylstyrene).

U.S. Pat. No. 4,997,697 discloses a transparent substrate material for receiving or containing an image which comprises a supporting substrate base, an antistatic polymer layer coated on one or both sides of the substrate and comprising hydrophilic cellulosic components, and a toner receiving polymer layer contained on one or both sides of the antistatic layer, which polymer comprises hydrophobic cellulose ethers, hydrophobic cellulose esters, or mixtures thereof, and wherein the toner receiving layer contains adhesive components.

U.S. Pat. No. 5,202,205, the disclosure of which is totally incorporated herein by reference, discloses a transparent substrate material for receiving or containing an image comprising a supporting substrate, an ink toner receiving coating composition on both sides of the substrate and comprising an adhesive layer and an antistatic layer contained on two surfaces of the adhesive layer, which antistatic layer comprises mixtures or complexes of metal halides or urea compounds, both with polymers containing oxyalkylene segments.

U.S. Pat. No. 5,212,008, the disclosure of which is totally incorporated herein by reference, discloses a recording sheet which comprises a substrate; a first coating in contact with the substrate which comprises a crosslinking agent selected from the group consisting of hexamethoxymethyl melamine, methylated melamine-formaldehyde, methylated urea-formaldehyde, cationic urea-formaldehyde, cationic polyamine-epichlorohydrin, glyoxal-urea resin, poly (aziridine), poly(acrylamide), poly(N,N-dimethyl acrylamide), acrylamide-acrylic acid copolymer, poly(2-acrylamido-2-methyl propane sulfonic acid), poly(N,N-dimethyl-3,5-dimethylene piperidinium chloride), poly (methylene-guanidine) hydrochloride, poly(ethylene imine) poly(ethylene imine) epichlorohydrin. poly(ethylene imine) ethoxylated, glutaraldehyde, and mixtures thereof; a catalyst; and a polymeric material capable of being crosslinked by the crosslinking agent and selected from the group consisting of polysaccharides having at least one hydroxy group, polysaccharides having at least one carboxy group, polysaccharides having at least one sulfate group, polysaccharides having at least one amine or amino group, polysaccharide gums, poly(alkylene oxides), vinyl polymers, and mixtures thereof; and a second coating in contact with the first coating which comprises a binder and a material selected from the group consisting of fatty imidazolines, ethosulfate quaternary compounds, dialkyl dimethyl methosulfate quaternary compounds, alkoxylated di-fatty quaternary compounds, amine oxides, amine ethoxylates, imidazoline quaternary compounds, alkyl benzyl dimethyl quaternary compounds, poly(epiamines), and mixtures thereof.

Copending application U.S. Ser. No. 444,477, the disclosure of which is totally incorporated herein by reference, discloses a recording sheet which comprises a substrate and a material selected from the group consisting of monosaccharides, oligosaccharides, and mixtures thereof.

U.S. Pat. No. 5,624,743, the disclosure of which is totally incorporated herein by reference, discloses a transparency comprised of a supporting substrate, thereover a first coating layer comprised of a binder having a glass transition temperature of less than about 55° C., a cellulosic viscosity modifier, a lightfastness inducing agent, and a biocide; and a second ink-receiving coating layer comprised of a hydrophilic binder, an oxyalkylene containing compound, a dye mordant, an optional filler, and an optional biocide; and wherein the first coating is in contact with the substrate and is situated between the substrate and the second ink coating, and which transparency possesses a haze value of from about 0.5 to about 10 and a lightfastness value of from about 80 to about 95.

Copending application U.S. Ser. No. 08/658,288, filed concurrently herewith, the disclosure of which is totally incorporated herein by reference, discloses a transparency comprised of a supporting substrate, thereover a first coating layer comprised of an anionic layer that adheres well to the substrate; and a second cationic layer situated on the top of the first anionic layer that binds with the anionic layer and comprised of cationic quaternary monomers and polymers thereof and a lightfastness inducing agent; and a third ink receiving layer situated on the top of the second cationic layer and comprised of block copolymers and graft polymers, a biocide and a filler; which transparency possesses a haze value of from about 0.5 to about 10 and a lightfastness value of from about 95 to about 98.

Copending application U.S. Ser. No. 08/657,218, filed concurrently herewith, the disclosure of which is totally incorporated herein by reference, discloses a transparency comprised of a supporting substrate, and thereover two coatings, a first heat dissipating and fire resistant coating layer in contact with the substrate and wherein said first coating is comprised of a binder with a melting point in the range of from about 100° to about 275° C. and a heat dissipating fire retardant component, and a second ink receiving coating layer thereover comprising a blend of a binder polymer, a cationic component, a lightfastness inducing agent, a filler, a biocide, and an ink spreading fluoro compound containing from 1 to about 25 fluorine atoms and having a melting point of between about 50° to about 100° C.

The disclosures of each of the patents and applications recited herein are totally incorporated herein by reference in their entirety.

While the above transparencies are suitable for their intended purposes, a need remains for improved transparencies particularly suitable for use in ink jet and electrophotographic applications. In addition, a need remains for transparencies that can be used in printers that employ slow drying black inks and fast drying colored inks. In addition, a need remains for transparencies with excellent low haze characteristics, such as haze between from about 1 to about 10 and preferably between 1 to 4, and excellent lightfastness in the range of from about 80 to about 95 percent, a feature not easily obtained considering that the total thickness of the two layered coatings can range from 2 to 50 microns and average about 25 microns. There is also a need for improved waterfastness of images in the ink jet transparencies, and a need for transparencies wherein colors can be satisfactorily projected. A need also remains for transparencies which are particularly suitable for use in printing processes wherein the recorded transparencies are imaged with liquid inks and dried by exposure to microwave radiation. Further, there is a need for transparencies coated with a discontinuous, porous film. There is also a need for transparencies which, subsequent to being imaged with an aqueous ink, exhibit reduced curling. These and other needs are achievable with the transparencies of the present invention in embodiments thereof.

SUMMARY OF THE INVENTION

It is an object of the present invention to provide transparencies with many of the advantages illustrated herein.

It is another object of the present invention to provide transparencies particularly suitable for use in electrophotographic and ink jet applications.

It is another object of the present invention to provide transparencies particularly suitable for ink jet printers employing slow drying black inks and fast drying colored inks.

It is another object of the present invention to provide transparencies with waterfast and lightfast images.

It is yet another object of the present invention to provide transparencies with low haze characteristics, such as from about 1 to about 10, and wherein the color gamut is acceptable and does not substantially change.

Moreover, another object of the present invention is to provide transparencies with the combination of excellent lightfastness properties, such as from about 80 to about 95, and low haze characteristics, such as from about 0.5 to about 10 and preferably from about 1 to about 5, wherein the color gamut is acceptable and does not substantially change.

These and other objects of the present invention can be accomplished in embodiments thereof by providing transparencies with coatings thereover. More specifically, the transparencies of the present invention are comprised of a supporting substrate, a first coating layer thereover of a super ink absorbent material, for example the acrylic acid-acrylamide copolymer #18545, obtained from Poly Sciences Inc., or cellulosics such as sodium carboxymethyl cellulose obtained from Aqualon Company, and a second ink spreading coating thereover comprised of a blend, or mixture of polyvinylalcohol and a component selected from the group consisting of hydroxy acids, amino acids and polycarboxyl compounds, a dye mordant, and a filler; and wherein said first and second coatings are present on both surfaces of the transparency primarily to protect images formed thereon from high humidity, and wherein dye mordants are added to the ink spreading top layer. Furthermore, in situations where, for example, excellent lightfastness is desired, for example greater than 95 percent, UV absorbers, antioxidants, and/or antiozonants may be incorporated in the ink spreading top layer. Additionally, to protect the coatings from bacterial degradation, appropriate biocides are incorporated in the coating compositions. Moreover, waterfastness components may be included.

Examples of substrate materials include polyesters, including MYLAR™, polyethylene terephthalate available from E.I. DuPont de Nemours & Company, MELINEX™, polyethylene terephthalate available from Imperial Chemicals, Inc., CELANAR™, polyethylene terephthalate available from Celanese Corporation, polyethylene naphthalates, such as Kaladex PEN films, available from Imperial Chemical Industries, polycarbonates, such as LEXAN™, available from General Electric Company, polysulfones, such as those available from Union Carbide Corporation, polyether sulfones, UDEL™, available from Union Carbide Corporation, polyether sulfones, VICTREX™, available from ICI Americas Incorporated, poly(arylene sulfones), cellulose triacetate, polyvinylchloride, cellophane, polyvinyl fluoride, polyimides, and the like, with polyester, such as MYLAR™, being preferred in view of its availability and relatively low cost. The substrate can also be opaque, including opaque MYLARS™, which are barium sulfate and titanium dioxide filled polyethylene terephthalate, such as TESLIN™, which is filled polypropylene with micro voids available from PPG Industries. Filled plastics can also be employed as the substrate, particularly when it is desired to make a "never-tear paper" recording sheet.

The substrate, which preferably includes two coatings thereon, and two coatings thereunder in contact with the substrate, can be of various effective thicknesses. Typical thicknesses for the substrate are from about 50 to about 500 microns, and preferably from about 100 to about 125 microns, although the thickness may be outside these ranges.

The first layer coating composition, which comprises at least one, and, for example, from 1 to about 5, and preferably to about 2 super ink absorbent binder includes, for example, the acrylic acid-acrylamide copolymer #18545, obtained from Poly Sciences Inc., a cellulosic super coabsorbent, such as sodium carboxymethyl cellulose obtained from Aqualon Company, or mixtures thereof, and a biocide present in various effective thicknesses. Typically, the total thickness of this first coating layer is from about 0.1 to about 25 microns and preferably from about 0.5 to 10 microns, although the thickness can be outside of these ranges. In the first coating composition, the super ink absorbent binder or mixtures thereof can be present within the coating in any effective amount; typically the binder or mixtures thereof are present in amounts of from about 24 parts by weight to about 75 parts by weight of one binder and from about 75 parts by weight to about 24 parts by weight of a second binder although the amounts can be outside of this range. The biocide is present in an amount of about 1 to about 4 parts by weight.

The preferred composition for the first layer coating in contact with the substrate of the transparency is 50 parts by weight of one super ink absorbent, such as acrylic acid-acrylamide copolymer, #18545, obtained from Poly Sciences Inc., 49.0 parts by weight of a second super ink absorbent, such as sodium carboxymethyl cellulose obtained from Aqualon Company, and 1 part by weight of the biocide compound, such as 2-hydroxypropylmethane thiosulfonate (Busan 1005 available from Buckman Laboratories Inc.).

The second layer coating composition situated on the top of the first ink absorbing layer can contain ink spreading polymers that are compatible with the slow drying black ink and fast drying colored inks, and which coating contains an ink/transparency compatibilizer selected from the group consisting of hydroxy acids, amino acids, and polycarboxyl compounds; a lightfastness inducing agent, an optional filler, optional dye mordant, and an optional biocide. Typically, the total thickness of this second coating layer is from about 0.1 to about 25 microns and preferably from about 0.5 to 10 microns, although the thickness can be outside of these ranges. In the second coating composition, the ink spreading polymers that are substantially or partly compatible with the slow drying black ink and fast drying colored inks can be present within the coating in any effective amount; typically the ink spreading polymers or mixtures thereof are present in amounts of from about 30 parts by weight to about 97 parts by weight although the amounts can be outside of this range. The ink/transparency compatibilizer components are present in amounts of from about 40 parts by weight to about 1 part by weight although the amounts can be outside of this range. The waterfastness inducing agents are present in amounts of from about 25 parts by weight to about 1.9 parts by weight although the amounts can be outside of this range. The filler is present in amounts of from about 5 parts by weight to about 0.1 part by weight although the amounts can be outside of this range The aforementioned amounts can be determined, for example, as follows:

Various blends of the ink spreading polymers that are partly compatible with the slow drying black and fast drying colored inks, the ink/transparency compatibilizer components, lightfastness inducing agents, filler and biocide were generated in water and coated on to a polyester sheet to yield transparencies with a single layer thereover and thereunder. After drying the polyester sheet at 100° C., these were tested for coating adhesion to polyester, printed with a Xerox Corporation ink jet test fixture to, for example, check print quality, drying times of the images, lightfastness, waterfastness and intercolor bleed. The data was analyzed statistically for optimum range of compositions. A preferred composition range for the second ink spreading layer of the transparency is the ink spreading polymer partly compatible with the slow drying black and fast drying colored inks present in amounts of from 30 parts by weight to about 97 parts by weight; the ink/transparency compatibilizer components are present in amounts of from about 40 parts by weight to about 1 part by weight; the waterfastness inducing agents are present in amounts of from about 25 parts by weight to about 1.9 parts by weight; and the filler is present in amounts of from about 5 parts by weight to about 0.1 part by weight(50+40+5+5) to (97+1+1.9+0.1).

Embodiments of the present invention include a transparency comprised of a supporting substrate, and thereover two coatings, a first super ink absorbent binder polymer coating that adheres to the substrate, such as polyacrylate salt or its copolymer acrylic acid-acrylamide copolymer, #18545, obtained from Poly Sciences Inc., and wherein the said super ink absorbent mixture is present in amounts of from about 24 parts by weight to about 75 parts by weight of one coating and from about 75 parts by weight to about 24 parts by weight of a second coating; a biocide is present in an amount of about 1 part by weight; and a second polyvinylalcohol ink spreading layer containing an ink/transparency compatibilizer, a lightfastness inducing agent compound hydroxy acids, amino acids, or polycarboxylic compounds, and a waterfastness inducing dye mordant, such as cationic quaternary compounds, and wherein the ink spreading polymer, or mixtures thereof are present in amounts of from about 30 parts by weight to about 97 parts by weight; the ink/transparency compatibilizer components are present in amounts of from about 40 parts by weight to about 1 part by weight; the waterfastness inducing agents are present in amounts of from about 25 parts by weight to about 1.9 parts by weight; the filler is present in amounts of from about 5 parts by weight to about 0.1 part by weight, and wherein the first coating is in contact with the substrate and is situated between the substrate and the second ink spreading coating, and which transparency possesses a haze value of from about 0.5 to about 10 and about 1 to about 6 and a lightfastness value of from about 80 to about 95; and a transparency wherein the superabsorbent coating of the first coating layer is water soluble material selected from the group consisting of (1) acrylamide-acrylic acid copolymers, (2) poly(acrylamide), (3) acrylic copolymer DP6-6066, acrylic copolymer DP6-7132 obtained from Allied Colloids, (4) poly(N,N-dimethyl acrylamide), and (5) poly(dimethyl acrylamide-acrylosarcosine methyl ester), #15776, available from Poly Sciences Inc.; and a supercoabsorber such as hydroxyalkyl starch, (1) methyl cellulose, (2) hydroxyethyl methyl cellulose, (3) hydroxy butylmethyl cellulose, (4) hydroxypropyl hydroxyethyl cellulose, (5) diethylammonium chloride hydroxy ethyl cellulose, (6) hydroxypropyl trimethyl ammonium chloride hydroxyethyl cellulose. (7) sodium carboxymethyl cellulose CMC 7HOF, (8) cellulose sulfate salts, (9) sodium carboxymethylhydroxyethyl cellulose CMHEC 43H and 37L, (10) polyacrylamide, and (11) polyethylene oxide; and mixtures thereof.

Embodiments of the present invention include a transparency comprised of a supporting substrate, thereover a first coating layer comprised of at least one ink, and preferably two, absorbing polymer layer and a biocide; and a second ink coating layer comprised of a hydrophilic vinyl binder, a waterfastness dye mordant, a filler, an optional lightfastness inducing agent, and an ink spot size increasing agent or compatibilizer selected from the group consisting of hydroxy acids, amino acids and polycarboxyl acids; and wherein the first coating is in contact with the substrate and is situated between the substrate and the second ink coating; a transparency comprised of a supporting substrate, thereover and thereunder a first coating layer comprised of an ink absorbent binder two polymer mixture with excellent adherence to the substrate, and wherein the first polymer of the mixture is present in amounts of from about 24 parts by weight to about 75 parts by weight, and the second polymer of the mixture is present in amounts of from about 75 parts by weight to about 24 parts by weight; a biocide present in an amount of about 1 part by weight; and a second polyvinylalcohol ink receiving layer containing hydroxy acids, amino acids, or polycarboxylic compounds, and waterfastness inducing dye mordants of cationic quaternary compounds, the waterfastness inducing component being present in amounts of from about 25 parts by weight to about 1.9 parts by weight, a filler present in amounts of from about 5 parts by weight to about 0.1 part by weight, and wherein the first coating is in contact with the substrate and is situated between the substrate and said second ink receiving layer coating, and which transparency possesses a haze value of from about 0.5 to about 6 and a lightfastness value of about 95, and wherein said second ink receiving coating contains an optional lightfastness inducing agent or agents.

One embodiment of the present invention includes a transparency with a first layer coating of a thickness of 10 microns, and is comprised of 50 parts by weight of the super absorbent acrylic acid-acrylamide copolymer #18545, obtained from Poly Sciences Inc., 49 parts by weight of a second ink coabsorber hydroxyethyl methyl cellulose (HEM, available from British Celanese Ltd.), or other similar known ink absorbers, and 1 part by weight of the biocide compound 2-hydroxypropylmethane thiosulfonate (Busan 1005, available from Buckman Laboratories Inc.); and a second 5 micron thick ink spreading layer situated on the top of the 10 micron thick first layer comprised of 55 parts by weight of polyvinyl alcohol 88 percent hydrolyzed available as Airvol 540-S from Air Products Company, 20 parts by weight of 3,5-dihydroxy benzoic acid (Aldrich #D11,000-0), and 24.9 parts by weight of a dye mordant polymethyl acrylate trimethyl ammonium chloride, HX42-1 available from Interpolymer Corporation, and 0.1 part by weight of colloidal silica available from W. R. Grace and Company. This transparency has a haze value of 2, lightfast values of about 95 percent, and waterfastness of greater than 75 percent.

Examples of the first layer absorbent polymers preferably in contact with both lateral surfaces of the substrate include water soluble polymers, such as:

(A) superabsorbents, such as (1) acrylic acid-acrylamide copolymers, such as #04652, #02220, and #18545, available from Poly Sciences Inc., (2) poly (acrylamide), such as #02806, available from Poly Sciences Inc., (3) acrylic copolymer DP6-6066, acrylic copolymer DP6-7132, obtained from Allied Colloids, (4) poly(N,N-dimethyl acrylamide), such as #004590 available from Poly Sciences Inc, and (5) poly (dimethyl acrylamide-acrylosarcosine methyl ester), #15776, available from Poly Sciences Inc.. Second polymers that may be present in the first layer include (B) coabsorbent polymers, such as (1) starch, such as starch SLS-280 available from St. Lawrence starch; (2) cationic starch, such as Cato-72 available from National Starch; (3) hydroxyalkyl starch, wherein alkyl has at least one carbon atom and wherein the number of carbon atoms is such that the material is water soluble, preferably from about 1 to about 20 carbon atoms, and more preferably from about 1 to about 10 carbon atoms, such as methyl, ethyl, propyl, butyl, or the like, such as hydroxypropyl starch (#02382 available from Poly Sciences Inc., and hydroxyethyl starch (#06733 available from Poly Sciences Inc.); (4) gelatin, such as Calfskin Gelatin, #00639, available from Poly Sciences Inc.; (5) alkyl celluloses and aryl celluloses, wherein alkyl has at least one carbon atom, and wherein the number of carbon atoms is such that the material is water soluble, preferably from 1 to about 20 carbon atoms, more preferably from 1 to about 10 carbon atoms, and even more preferably from 1 to about 7 carbon atoms, such as methyl, ethyl, propyl, butyl, pentyl, hexyl, benzyl, and the like, such as methyl cellulose (Methocel AM 4 available from Dow Chemical Company), and wherein aryl has at least 6 carbon atoms and wherein the number of carbon atoms is such that the material is water soluble, preferably from 6 to about 20 carbon atoms, more preferably from 6 to about 10 carbon atoms, and even more preferably about 6 carbon atoms, such as phenyl; (6) hydroxy alkyl celluloses, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, benzyl, or the like, such as hydroxyethyl cellulose, Natrosol 250 LR available from Hercules Chemical Company, and hydroxypropyl cellulose (Klucel Type E available from Hercules Chemical Company); (7) alkyl hydroxy alkyl celluloses, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, benzyl, or the like, such as ethyl hydroxyethyl cellulose, Bermocoll available from Berol Kem. A.B. Sweden; (8) hydroxy alkyl alkyl celluloses, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, such as hydroxyethyl methyl cellulose (HEM available from British Celanese Ltd., also available as Tylose MH, MHK from Kalle A.G.), hydroxypropyl methyl cellulose (Methocel K35LV available from Dow Chemical Company), and hydroxy butylmethyl cellulose, such as HBMC available from Dow Chemical Company; (9) dihydroxyalkyl cellulose, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, such as dihydroxypropyl cellulose, which can be prepared by the reaction of 3-chloro-1,2-propane with alkali cellulose; (10) hydroxy alkyl hydroxy alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, such as hydroxypropyl hydroxyethyl cellulose available from Aqualon Company; (11 ) halodeoxycellulose, wherein halo represents a halogen atom, such as chlorodeoxycellulose, which can be prepared by the reaction of cellulose with sulfuryl chloride in pyridine at 25° C.; (12) amino deoxycellulose, which can be prepared by the reaction of chlorodeoxy cellulose with 19 percent alcoholic solution of ammonia for 6 hours at 160° C.; (13) dialkylammonium halide hydroxy alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein halide represents a halogen atom, such as diethylammonium chloride hydroxy ethyl cellulose, available as Celquat H-100, L-200, National Starch and Chemical Company; (14) hydroxyalkyl trialkyl ammonium halide hydroxyalkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein halide represents a halogen atom, such as hydroxypropyl trimethyl ammonium chloride hydroxyethyl cellulose available from Union Carbide Company as Polymer Jr; (15) dialkyl amino alkyl cellulose, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, such as diethyl amino ethyl cellulose available from Poly Sciences Inc. as DEAE cellulose #05178; (16) carboxyalkyl dextrans, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, pentyl, hexyl, and the like, such as carboxymethyl dextrans available from Poly Sciences Inc. as #16058; (17) dialkyl aminoalkyl dextran, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, such as diethyl aminoethyl dextran available from Poly Sciences Inc. as #5178; (18) amino dextran (available from Molecular Probes Inc.); (19) carboxy alkyl cellulose salts, wherein alkyl has at least one carbon atom, and wherein the number of carbon atoms is such that the material is water soluble, preferably from 1 to about 20 carbon atoms, more preferably from 1 to about 10 carbon atoms, such as methyl, ethyl, propyl, butyl and the like, and wherein the cation is any conventional cation, such as sodium, lithium, potassium, calcium, magnesium, or the like, such as sodium carboxymethyl cellulose CMC 7HOF available from Hercules Chemical Company; (20) gum arabic, such as #G9752 available from Sigma Chemical Company; (21) carrageenan, such as #C1013 available from Sigma Chemical Company; (22) karaya gum, such as #G0503 available from Sigma Chemical Company; (23) xanthan, such as Keltrol-T available from Kelco division of Merck and Company; (24) chitosan, such as #C3646 available from Sigma Chemical Company; (25) carboxyalkyl hydroxyalkyl guar, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, such as carboxymethyl hydroxypropyl gua, available from Auqualon Company; (26) cationic guar, such as Celanese Jaguars C-14-S, C-15, C-17 available from Celanese Chemical Company; (27) n-carboxyalkyl chitin, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, such as n-carboxymethyl chitin; (28) dialkyl ammonium hydrolyzed collagen protein, wherein alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, such as dimethyl ammonium hydrolyzed collagen protein, available from Croda as Croquats; (29) agar-agar, such as that available from Pfaltz and Bauer Inc.; (30) cellulose sulfate salts, wherein the cation is any conventional cation, such as sodium, lithium, potassium, calcium, magnesium, or the like, such as sodium cellulose sulfate #023 available from Scientific Polymer Products; (31) carboxyalkylhydroxyalkyl cellulose salts, wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl and the like, and wherein the cation is any conventional cation, such as sodium, lithium, potassium, calcium, magnesium, or the like, such as sodium carboxymethylhydroxyethyl cellulose CMHEC 43H and 37L available from Hercules Chemical Company; (32) poly (oxyethylene) or poly(ethylene oxide), such as POLY OX WSRN-3000 available from Union Carbide Corporation; (33) ethylene oxide/2-hydroxyethyl methacrylate/ethylene oxide and ethylene oxide/hydroxypropyl methacrylate/ethylene oxide triblock copolymers, which can be synthesized via free radical polymerization of hydroxyethyl methacrylate or hydroxypropyl methacrylate with 2-aminoethanethiol using α,α'-azobisisobutyronitrile as initiator, and reacting the resulting amino-semitelechelic oligo-hydroxyethyl methacrylate or amino-hydroxypropyl methacrylate with an isocyanate-polyethylene oxide complex in chlorobenzene at 0° C., and precipitating the reaction mixture in diethylether, filtering and drying in vacuum; (34) ethylene oxide/4-vinyl pyridine/ethylene oxide triblock copolymers, which can be synthesized via anionic polymerization of 4-vinyl pyridine with sodium naphthalene as initiator at −78° C. and then adding ethylene oxide monomer, the reaction being carried out in an explosion proof stainless steel reactor, ionene/ethylene oxide/ionene triblock copolymers, which can be synthesized via quaternization reaction of one end of each 3—3 ionene with the halogenated, preferably brominated, poly(oxyethylene) in methanol at about 40° C.; (35) ethylene oxide/isoprene/ethylene oxide triblock copolymers, which can be synthesized via anionic polymerization of isoprene with sodium naphthalene in tetrahydrofuran as solvent at −78° C., and then adding monomer ethylene oxide and polymerizing the reaction for three days, after which time the reaction is quenched with methanol, the ethylene oxide content in the aforementioned triblock copolymers being from about 20 to about 70 percent by weight and preferably about 50 percent by weight; and the like, as well as mixtures thereof.

Examples of suitable biocides include (A) nonionic biocides, such as (1) 2-hydroxypropylmethane thiosulfonate (Busan 1005 available from Buckman Laboratories Inc.); (2) 2-(thio cyanomethyl thio) benzothiazole (Busan 30WB, 72WB, available from Buckman Laboratories Inc.); (3) methylene bis(thiocyanate) (Metasol T-10 available from Calgon Corporation; AMA-110 available from Vinings Chemical Company; VICHEM MBT available from Vineland Chemical Company; Aldrich 10,509-0); (4) 2-bromo-4'-hydroxyacetophenone (Busan 90 available from Buckman Laboratories); (5) 1,2-dibromo-2,4-dicyano-butane (Metasol CB-210, CB-235, available from Calgon Corporation); (6) 2,2-dibromo-3-nitropropionamide (Metasol RB-20 available from Calgon Corporation; Amerstat 300 available from Drew Industrial Div.); (7) N-α-(1-nitroethyl benzylethylene diamine) (Metasol J-26 available from Calgon Corporation); (8) dichlorophene (G-4 available from Givaudan Corporation); (9) 3,5-dimethyl tetrahydro-2H-1,3,5-thiadiazine-2-thione (Slime-Trol RX-28 available from Betz Paper Chem Inc.; Metasol D3T-A available from Calgon Corporation; Slime Arrest available from Western Chemical Company); (10) a nonionic blend of a sulfone, such as bis(trichloromethyl) sulfone and methylene bisthiocyanate (available as Slime-Trol RX-38A from Betz Paper Chem Inc.); (11) a nonionic blend of methylene bisthiocyanate and bromonitrostyrene (available as Slime-Trol RX-41 from Betz Paper Chem Inc.); (12) a nonionic blend of 2-(thiocyanomethylthio) benzothiazole (53.2 percent by weight) and 2-hydroxypropyl methanethiosulfonate (46.8 percent by weight) (available as Busan 25 from Buckman Laboratories Inc.); (13) a nonionic blend of methylene bis(thiocyanate), 50 percent by weight, and 2-(thiocyanomethylthio) benzothiazole, 50 percent by weight, (available as Busan 1009, 1009WB from Buckman Laboratories Inc.); (14) a nonionic blend of 2-bromo-4'-hydroxyacetophenone, 70 percent by weight, and 2-(thiocyanomethylthio) benzothiazole, 30 percent by weight, (Busan 93 available from Buckman Laboratories Inc.); (15) a nonionic blend of 5-chloro-2-methyl-4-isothiazoline-3-one, 75 percent by weight, and 2-methyl-4-isothiazolin-3-one, 25 percent by weight (available as Amerstat 250 from Drew Industrial Division; Nalcon 7647 from Nalco Chemical Company; Kathon LX from Rohm and Haas Company); and the like, as well as mixtures thereof; (B) anionic biocides, such as (1) anionic potassium N-hydroxymethyl-N-methyl-dithiocarbamate (available as Busan 40 from Buckman Larboratories Inc.); (2) an anionic blend of N-hydroxymethyl-N-methyl dithiocarbamate, 80 percent by weight, and sodium 2-mercapto benzothiazole, 20 percent by weight, (available as Busan 52 from Buckman Laboratories Inc.); (3) an anionic blend of sodium dimethyl dithiocarbamate, 50 percent by weight, and disodium ethylenebis-dithiocarbamate, 50 percent by weight, (available as Metasol 300 from Calgon Corporation; Amerstat 272 from Drew Industrial Division; Slime Control F from Western Chemical Company); (4) an anionic blend of N-methyldithiocarbamate, 60 percent by weight, and disodium cyanodithioimidocarbonate, 40 percent by weight, (available as Busan 881 from Buckman Laboratories Inc.); (5) an anionic blend of methylene bis-thiocyanate, 33 percent by weight, sodium dimethyl-dithiocarbamate, 33 percent by weight, and sodium ethylene bisdithiocarbamate, 33 percent by weight, (available as Amerstat 282 from Drew Industrial Division; AMA-131 from Vinings Chemical Company); (6) sodium dichlorophene (G-4-40 available from Givaudan Corporation); and the like, as well as mixtures thereof; (C) cationic biocides, such as (1) cationic poly(oxyethylene (dimethylamino)-ethylene (dimethylamino) ethylene dichloride) (Busan 77 available from Buckman Laboratories Inc.); (2) a cationic blend of methylene bisthiocyanate and dodecyl guanidine hydrochloride (available as Slime-Trol RX-31, RX-32, RX-32P, RX-33, from Betz Paper Chem Inc.); (3) a cationic blend of a sulfone, such as bis(trichloromethyl) sulfone and a quaternary ammonium chloride (available as Slime-Trol RX-36 DPB-865 from Betz Paper Chem. Inc.); (4) a cationic blend of methylene bisthiocyanate and chlorinated phenols (available as Slime-Trol RX-40 from Betz Paper Chem Inc.); and the like, and mixtures thereof. The biocide can be present in any effective amount; typically, the biocide is present in an amount of from about 0.1 part by weight to about 3 parts by weight of the coating, although the amount can be outside this range.

Ink spreading components, or ink spot size increasing agents are selected from the group consisting of hydroxy acids, amino acids, and polycarboxyl compounds. Typically, the total thickness of this second coating layer is from about 0.1 to about 25 microns and preferably from about 0.5 to 10 microns, although the thickness can be outside of these ranges. The waterfastness inducing agents are present in amounts of from about 25 parts by weight to about 1.9 parts by weight although the amounts can be outside of this range. The filler is present in amounts of from about 5 parts by weight to about 0.1 part by weight although the amounts can be outside of this range. Typically, the total thickness of the second coating layer is from about 0.1 to about 25 microns and preferably from about 0.5 to 10 microns, although the thickness can be outside of these ranges.

Examples of the second layer ink spreading polymers or binders that are partly compatible with the slow drying black ink and fast drying colored inks in contact with the super ink absorbent layer situated on the substrate include water soluble polymers such as vinyl polymers, such as (1) poly(vinyl alcohol), such as Elvanol available from DuPont Chemical Company), poly (vinyl alcohol), 88 percent hydrolyzed available as Airvol 205, Airvol 523, Airvol 540S, available from Air Products Company, (2) poly(vinyl phosphate), such as #4391 available from Poly Sciences Inc., (3) poly(vinyl pyrrolidone), such as that available from GAF Corporation, (4) vinyl pyrrolidone-vinyl acetate copolymers, such as #02587 available from Poly Sciences Inc., (5) vinyl pyrrolidone-styrene copolymers, such as #371 available from Scientific Polymer Products, (6) poly(vinylamine), such as #1562 available from Poly Sciences Inc., (7) poly(vinyl alcohol) alkoxylated, wherein alkyl has at least one carbon atom, and wherein the number of carbon atoms is such that the material is water soluble, preferably from 1 to about 20 carbon atoms, more preferably from 1 to about 10 carbon atoms, such as methyl, ethyl, propyl, butyl, and the like, such as poly(vinyl alcohol) ethoxylated #6573 available from Poly Sciences Inc., and (8) poly(vinyl pyrrolidone-dialkylaminoalkyl alkylacrylate), wherein each alkyl has at least one carbon atom and wherein the number of carbon atoms is such that the material is water soluble, preferably from 1 to about 20 carbon atoms, more preferably from 1 to about 10 carbon atoms, such as methyl, ethyl, propyl, butyl, and the like, such as poly(vinyl pyrrolidone-diethylaminomethylmethacrylate), #16294 and #16295, available from Poly Sciences Inc.

The second layer of the present invention contains, as illustrated herein, amino acids, hydroxy acids, polycarboxyl compounds, and mixtures thereof.

Amino acids generally are those compounds with both an amine functional group and an acid functional group. Examples of suitable amino acids include (I) those of the general formula $R_1$-$(CH_2)_n$-$CH_2$-($NHR_3$)-COOH, wherein $R_1$ is selected from the group consisting of alkyl, phenyl, hydroxyl, mercaptyl, sulfonic acid, alkyl sulfonic acid, alkyl mercaptyl, phenol, thio, carboxyl, indole, acetamide alkane, 1-alkyl indole, imidazole, aminophenyl, carboxy alkyl, amido alkyl, glutamyl, amino carbonyl, alkyl thio alkyl, amino alkyl, dihydroxy phenyl, vinyl, allyl, amino sulfamoyl, guanidyl alkane, benzyloxy phenyl, S-carbamyl, dicarboxy alkyl, carbobenzyloxy amine, S-trityl, tert-alkoxy carbonyl amine, S-tert alkylthio, S-carboxyalkyl, alkyl sulfoxide alkane, alkyl sulfoximine, hydroxy alkyl, mercaptyl alkyl, thiazolyl, aminoalkane, and amine; $R_3$ is selected from the group consisting of hydrogen, carbobenzyloxy, glycyl, N-tert-butoxy carbonyl, and acetyl; and n represents the number of repeating units, such as (a) when $R_1$=$CH_3$, $R_3$=H, and n varies from 0 to 5, including (1) n=0, alanine $CH_3CH(NH_2)COOH$ (Aldrich 13,522-4, 16,265-5, A2, 680-2); (2) n=1, 2-aminobutyric acid $CH_3(CH_2)CH(NH_2)COOH$ (Aldrich 16,266-3, 11,612-2, 23,438-9); (3) n=2, norvaline $CH_3(CH_2)_2CH(NH_2)COOH$ (Aldrich 22,284-4); (4) n=3, norleucine $CH_3(CH_2)_3CH(NH_2)COOH$ (Aldrich 17,109-3); (5) n=5, 2-amino caprylic acid $CH_3(CH_2)_5$ $CH(NH_2)COOH$ (Aldrich 21,770-0); (b) when $R_1$=$C_6H_5$, $R_3$=H, and n varies from 0 to 5, including (1) n=0, 2-phenyl glycine $C_6H_5CH(NH_2)COOH$ (Aldrich P2, 550-7); (2) n=1, phenyl alanine $C_6H_5CH_2CH(NH_2)COOH$ (Aldrich 14,796-6, P1,700-8); (3) n=2, homophenyl alanine $C_6H_5(CH_2)_2CH$ $(NH_2)COOH$ (Aldrich 29,435-7, 29,436-5, 29,437-3); (c) when n=1, $R_3$=H, and $R_1$ varies, including (1) $R_1$=HO, such as serine $HOCH_2CH(NH_2)COOH$ (Aldrich S259-7); (2) $R_1$=HS, such as cysteine $HSCH_2CH(NH_2)COOH$ (Aldrich 86,167-7, 16,814-9); (3) $R_1$=$HO_3S$, such as cysteic acid monohydrate $HO_3SCH_2CH(NH_2)COOH.H_2O$ (Aldrich 85,189-2); (4) $R_1$=$HO_3SCH_2$, such as homocysteic acid $HO_3SCH_2CH_2CH(NH_2)COOH$ (Aldrich 21,974-6); (5) $R_1$=$(CH_3)_2SH$, such as leucine $(CH_3)_2CHCH_2CH$ $(NH_2)COOH$ (Aldrich 16,272-8); (6) $R_1$=$HOC_6H_4$, such as tyrosine 4-$HOC_6H4CH_2CH(NH_2)COOH$ (Aldrich 85,545-6, 14,572-6, T9,040-9); (7) $R_1$=S, such as cystine $[S\text{-}CH_2CH(NH_2)COOH]_2$ (Aldrich C12,200-9, 28,546-3, 29,867-0); (8) $R_1$=HOOC, such as aspartic acid $HOOCCH_2CH(NH_2)COOH$ (Aldrich A9,309-7, 21,909-6, A9,310-0); (9) $R_1$=$[C_5H_3(=0)(OH)N]$, such as leucenol and mimosine $C_5H_3(=0)(OH)NCH_2CH(NH_2)COOH$ (Aldrich M8,761-4); (10) $R_1$=$CH_3CONH(CH_2)3$, such as acetyl-L-lysine $CH_3CONH(CH_2)_3CH_2CH(NH_2)COOH$ (Aldrich 11,579-7); (11) $R_1$=$C_8H_6NH$, such as tryptophan $C_8H_6NHCH_2CH(NH_2)COOH$ (Aldrich 15,628-0, 16,269-8, T9,020-4); (12) $R_1$=$(C_6H_5)_3CS$, such as (S)-trityl-L-cysteine $(C_6H_5)_3CSCH_2CH(NH_2)COOH$ (Aldrich 16,473-9); (13) $R_1$=$C_8H_6N(CH_3)$, such as 1-methyl D,L-tryptophan $C_8H_6N(CH_3)CH_2CH(NH_2)COOH$ (Aldrich 86,064-6); (14) $R_1$=$C_3H_3N_2$, such as histidine $C_3H_3N_2CH_2CH(NH_2)COOH$ (Aldrich 15,168-8, 21,973-8); (15) $R_1$=$H_2NC_6H_4$, such as 4-amino phenylalanine hydrate $H_2NC_6H_4CH_2CH(NH_2)COOH.xH_2O$ (Aldrich 85,870-6, 34,824-4, 34,825-2); (16) $R_1$=$HOOCCH_2$, such as glutamic acid $HOOCCH_2CH_2CH(NH_2)COOH$ (Aldrich 12,843-0, 85,735-1 and G279-6); (17) $R_1$=$H_2NCOCH_2$, such as glutamine $H_2NCOCH_2CH_2CH(NH_2)COOH$ (Aldrich G,320-2); and (18) $R_1$=$HOOCCH_2CH_2CH(COOH)$ $NHCOCH_2$, such as γ-L-glutamyl-L-glutamic acid $HOOCCH_2CH_2CH(COOH)NHCOCH_2CH_2CH(NH_2)$ COOH (Aldrich 85,927-3).

Further, suitable are (IV) imino acids containing NH and COOH groups, such as (1) n-trityl glycine $[(C_6H_5)_3CNHCH_2COOH]$ (Aldrich 30,151-5); (2) 2-acetamido acrylic acid $H_2C$=$C(NHCOCH_3)COOH$ (Aldrich A140-1); (3) 4-acetamido benzoic acid $CH_3CONHC_6H_4COOH$ (Aldrich 13,333-7); (4) α-acetamido cinnamic acid $C_6H_5CH$=$C(NHCOCH_3)COOH$ (Aldrich 21,385-3); (5) 6-acetamido hexanoic acid $CH_3CONH(CH_2)_5COOH$ (Aldrich 19,430-1); (6) acetamido acetic acid $CH_3CONHCH_2COOH$ (Aldrich A1,630-0); (7) N-(2-mercapto propionyl) glycine $CH_3CH(SH)$ $CONHCH_2COOH$ (Aldrich 28,096-8); and the like.

Moreover, suitable are (V) amino acids of the general formula $H_2N$—(R)—$SO_3H$, wherein R is selected from the group consisting of alkane, alkylene oxide, phenyl, naphthyl, amino benzene, and acetamido alkane, such as (a) when R=$(CH_2)_n$ and n varies, for example, from 1 to 12, including (1) n=0, such as sulfamic acid $H_2NSO_3H$ (Aldrich 24,278-0); (2) (n=1), R=$CH_2$, such as amino methane sulfonic acid $H_2N(CH_2)SO_3H$ (Aldrich 12,744-2); (3) (n=2), R=$(CH_2)_2$, such as α-2-aminoethane sulfonic acid $H_2N$ $(CH_2)_2SO_3H$ (Aldrich 15,224-2); (4) (n=3), R=$(CH_2)_3$, such as 3-amino-1-propane sulfonic acid $H_2N(CH_2)_3SO_3H$ (Aldrich A7,610-9); (b) when R is different from $(CH_2)_n$, including (1) R=$CH_2CH_2O$, such as 2-amino ethyl hydrogen sulfate $H_2NCH_2CH_2OSO_3H$ (Aldrich A5,440-7); (2) R=$C_6H_4$, such as sulfanilic acid $H_2NC_6H_4SO_3H$ (Aldrich 11,273-9); (3) R=$C_{10}H_6$, such as 2-amino-1-naphthalene sulfonic acid $H_2NC_{10}H_6SO_3H$ (Aldrich 29,113-7); (4) R=$H_2NC_6H_3$, such as 2,5-diamino benzene sulfonic acid $(H_2N)_2C_6H_3SO_3H$ (Aldrich 15,350-8); (5) R=$COCH_2NHCH_2CH_2$, such as [N-(2-acetamido) 2-amino ethane sulfonic acid] $H_2NCOCH_2NHCH_2CH_2SO_3H$ (Aldrich 85,760-2); and the like.

Hydroxy acids generally are compounds having both a hydroxy functional group and an acid functional group. Examples of suitable hydroxy acids include (I) those of the general formula HO[R]XH, wherein R is selected from the group consisting of alkane, cycloalkane, phenyl, alkoxy phenyl, dialkoxy phenyl, alkyl phenyl, and phenyl alkene, and X is an anion, such as $COO^-$, $SO_3^-$, $NO_3^-$, or the like, including (1) glycolic acid $HOCH_2COOH$ (Aldrich 12473-7); (2) 10-hydroxydecanoic acid $HO(CH_2)_9COOH$ (Aldrich 28,421-1); (3) 12-hydroxydodecanenoic acid $HO(CH_2)$ $_{11}COOH$ (Aldrich 19,878-1); (4) 16-hydroxy hexadecanoic acid $HO(CH_2)_{15}COOH$ (Aldrich 17,749-0); (5) 1-hydroxy-1-cyclopropane carboxylic acid $HOC_3H_4COOH$ (Aldrich 29,388-1); (6) hydroxy benzoic acid $HOC_6H_4COOH$ (Aldrich $H_{2,000}$-8, 24,014-1, $H_{2,005}$-9); (7) 3-hydroxy-4-methoxy benzoic acid $HOC_6H_3(OCH_3)COOH$ (Aldrich 22,010-8); (8) 4-hydroxy-3-methoxy benzoic acid $HOC_6H_3$ $(OCH_3)COOH$ (Aldrich $H_{3,600}$-1); (9) 4-hydroxy-3,5-dimethoxy benzoic acid 4-(HO)$C_6H_2$-3,5-$(OCH_3)$2COOH (Aldrich S800-5); (10) 3-hydroxy-4,5-dimethoxy benzoic acid $HOC_6H_2(OCH_3)_2COOH$ (Aldrich 26,845-3); (11) 2-hydroxy-3-isopropyl-6-methyl benzoic acid $HOC_6H_2[CH(CH_3)_2](CH_3)COOH$ (Aldrich 33,991-1); (12) 2-hydroxy-6-isopropyl-3-methyl benzoic acid $HOC_6H_2[CH(CH_3)_2](CH_3)COOH$ (Aldrich 34,097-9); (13) hydroxy cinnamic acid $HOC_6H_4CH{=}CHCOOH$ (Aldrich H2,280-9, H2,300-7, H2,320-1); (14) 3-hydroxy-4-methoxy cinnamic acid $HOC_6H_3(OCH_3)CH{=}CHCOOH$ (Aldrich 10,301-2); (15) 4-hydroxy-3-methoxy cinnamic acid $HOC_6H_3(OCH_3)CH{=}CHCOOH$ (Aldrich 12,870-8); (16) 3,5-dimethoxy-4-hydroxy cinnamic acid $HOC_6H_2(OCH_3)_2CH{=}CHCOOH$ (Aldrich D13,460-0); (17) 2-hydroxyhippuric acid $HOC_6H_4CONHCH_2COOH$ (Aldrich 13,406-6); (18) hydroxy phenyl acetic acid $HOC_6H_4CH_2COOH$ (Aldrich H,980-4, H4,990-1, H5,000-4); (19) 4-hydroxy-3-methoxy phenyl acetic acid $HOC_6H_3(OCH_3)CH_2COOH$ (Aldrich 14,364-2); (20) D,L-3-(4-hydroxyphenyl) lactic acid hydrate $HOC_6H_4CH_2CH(OH)COOH.xH_2O$ (Aldrich 28.618-4); (21) 4-hydroxyphenyl pyruvic acid $HOC_6H_4CH_2COCOOH$ (Aldrich 11,428-6); (22) 4-hydroxy benzene sulfonic acid $HOC_6H_4SO_3H$ (Aldrich 17,150-6); (23) 3[(1,1-dimethyl-2-hydroxyethyl) amino]-2-hydroxy propane sulfonic acid $HOCH_2C(CH_3)_2NHCH_2CH(OH)CH_2SO_3H$ (Aldrich 34,016-2); mixtures thereof, and the like.

Further suitable hydroxy acids in embodiments are (II) those of the general formula $R_1R_2(OH)COOH$, wherein $R_1$ and $R_2$ are each independently selected from the group consisting of alkyl, dialkyl, phenyl, alkoxy, halide, hydroxy, phenyl, dihalide vinyl acrylamide, cycloalkane, and halogenated hydroxyl phenyl, including (1) lactic acid $CH_3CH(OH)COOH$ (Aldrich L5-2); (2) 3-hydroxybutyric acid $CH_3CH(OH)CH_2COOH$ (Aldrich H2,220-5); (3) 2-hydroxyisobutyric acid $(CH_3)2C(OH)COOH$ (Aldrich 32,359-4, 16,497-6); (4) 2-ethyl-2 hydroxybutyric acid $(C_2H_5)_2C(OH)COOH$ (Aldrich 13,843-6); (5) 2-hydroxy-3-methyl butyric acid (2-hydroxy isovaleric acid) $(CH_3)_2CHCH(OH)COOH$ (Aldrich 21,983-5); (6) 2-hydroxy-2-methyl butyric acid $C_2H_5C(CH_3)(OH)COOH$ (Aldrich H4,000-9); (7) D,L-2-hydroxy caproic acid $CH_3(CH_2)_3CH(OH)COOH$ (Aldrich 21,980-0); (8) hydroxyisocaproic acid $(CH_3)_2CHCH_2CH(OH)COOH$ (Aldrich 21,981-9, 21,982-7); (9) D,L mandelic acid $C_6H_5CH(OH)COOH$ (Aldrich M210-1); (10) (±)-4-methoxy mandelic acid $CH_3OC_6H_4CH(OH)COOH$ (Aldrich 29,688-0); (11) 4-bromo mandelic acid $BrC_6H_4CH(OH)COOH$ (Aldrich B7,120-9); (12) D,L-3-hydroxy-4-methoxy mandelic acid $HOC_6H_3(OCH_3)CH(OH)COOH$ (Aldrich 23,542-3); (13) D,L-4-hydroxy-3-methoxy mandelic acid $HOC_6H_3(OCH_3)CH(OH)COOH$ (Aldrich 14,880-6); (14) D,L-4-hydroxy mandelic acid monohydrate $HOC_6H_4CH(OH)COOH.H_2O$ (Aldrich 16,832-7); (15) 3-chloro-4-hydroxy benzoic acid hemihydrate $ClC_6H_3(OH)COOH.½H_2O$ (Aldrich C4,460-5); (16) 2-hydroxy-3-isopropyl benzoic acid $(CH_3)_2CHC_6H_3(OH)COOH$ (Aldrich 34,366-8); (17) 3,5-dibromohydroxy benzoic acid $(Br)_2C_6H_2(OH)COOH$ (Aldrich 25,134-8); (18) 3,5-dichloro hydroxy benzoic acid $(Cl)_2C_6H_2(OH)COOH$ (Aldrich D6,400-7); (19) benzilic acid $(C_6H_5)_2C(OH)COOH$ (Aldrich B519-4); (20) 2-(4-hydroxy phenoxy) propionic acid $CH_3CH(OC_6H_4OH)COOH$ (Aldrich 32,899-5); (21) α-hydroxy hippuric acid $C_6H_5CONHCH(OH)COOH$ (Aldrich 22,387-5); (22) 3,5-diisopropyl salicylic acid $[(CH_3)_2CH]_2C_6H_2$-2-(OH)COOH (Aldrich 13,569-0); (23) 3-chloro-4-hydroxy phenyl acetic acid $ClC_6H_3(OH)CH_2COOH$ (Aldrich 22,452-9); (24) D,L-12-hydroxystearic acid $CH_3(CH_2)_5CH(OH)(CH_2)_{10}COOH$ (Aldrich 21,996-7); (25) tropic acid $C_6H_5CH(CH_2OH)COOH$ (Aldrich T8,920-6); (26) 2-acrylamido glycolic acid monohydrate $H_2C{=}CHCONHCH(OH)COOH.H_2O$ (Aldrich 26,049-5); (27) hexahydromandelic acid $C_6H_{11}CH(OH)COOH$ (Aldrich 30,114-0, 30,115-9); and the like; or those of the general formula $(HO)_2RCOOH$, wherein R is selected from the group consisting of phenyl, acrylic phenyl, phenyl alkyl, phenyl hydroxy, alkyl, naphthyl, alkane amine, diphenyl alkyl, and amino alkyl, including (1) dihydroxy benzoic acid $(HO)_2C_6H_3COOH$ (Aldrich 12,620-9, D10,940-1, 14,935-7, D10,960-6, D10,980-0, D11,000-0); (2) 3,4-dihydroxy cinnamic acid $(HO)_2C_6H_3CH{=}CHCOOH$ (Aldrich D11,080-9); (3) 3,4-dihydroxy hydro cinnamic acid $(HO)_2C_6H_3CH_2CH_2COOH$ (Aldrich 10,260-1); (4) D,L-3,4-dihydroxy mandelic acid $(HO)_2C_6H_3CH(OH)COOH$ (Aldrich 15,161-0); (5) 3,5-dihydroxy-4-methyl benzoic acid hemihydrate $CH_3C_6H_2(OH)_2COOH.½H_2O$ (Aldrich 31,848-5); (6) dihydroxy naphthoic acid $(HO)_2C_{10}H_5COOH$ (Aldrich 28,125-5, 27,529-8, 27,527-1); (7)dihydroxy phenylacetic acid $(HO)_2C_6H_3CH_2COOH$ (Aldrich 16,868-8, 85,021-7); (8) bicine $(HOCH_2CH_2)_2NCH_2COOH$ (Aldrich 16,379-1); (9) 2,2-bis(hydroxymethyl)propionic acid $CH_3C(CH_2OH)_2COOH$ (Aldrich 10,661-5); (10) 4,4-bis(4-hydroxyphenyl) valeric acid $CH_3C(C_6H_4OH)_2CH_2CH_2COOH$ (Aldrich B4,770-7); (11) tris (hydroxymethyl) amino methane succinate $[(HOCH_2)_3CNH_2]_2HOOCCH_2CH_2COOH$ (Aldrich 34,068-5); and the like.

Polycarboxyl compounds generally are those compounds with at least two carboxyl functional groups. Examples of suitable polycarboxyl compounds include (I) aliphatic dicarboxy-functional compounds, including (a) compounds of the general formula $HOOC(CH_2)_nCOOH$ and their derivatives, wherein n represents the number of repeating units, including (1) [n=0], such as oxalic acid HOOCCOOH, such as oxalic acid dihydrate $HOOCCOOH.2H_2O$ (Aldrich 0-875-5); (2) [n=1], such as malonic acid $HOOCCH_2COOH$ (Aldrich M129-6); (3) [n=2], such as succinic acid $HOOC(CH_2)_2COOH$ (Aldrich 13,438-4); (4) [n=3], such as glutaric acid $HOOC(CH_2)_3COOH$ (Aldrich G340-7); (5) [n=4], such as adipic acid $HOOC(CH_2)_4COOH$ (Aldrich 24,052-4); (6) [n=5], such as pimelic acid $HOOC(CH_2)_5COOH$ (Aldrich P4,500-1); (7) [n=6], such as suberic acid $HOOC(CH_2)_6COOH$ (Aldrich S520-0); (8) [n=7], such as azelaic acid $HOOC(CH_2)_7COOH$ (Aldrich A9,615-0); (9) [n=8], such as sebacic acid $HOOC(CH_2)_8COOH$ (Aldrich S175-2); (10) [n=9], such as undecanedioic acid $HOOC(CH_2)_9COOH$ (Aldrich 17,796-2); (11) [n=10], such as 1,10-decane dicarboxylic acid $HOOC(CH_2)_{10}COOH$ (Aldrich D100-9); (12) [n=11], such as 1,11-undecane dicarboxylic acid $HOOC(CH_2)_{11}COOH$ (Aldrich U60-1); (13) [n=12], such as 1,12-dodecane dicarboxylic acid $HOOC(CH_2)_{12}COOH$ (Aldrich D22,120-1); (14) [n=14], such as hexadecanedioic acid $HOOC(CH_2)_{14}COOH$ (Aldrich 17,750-4); (15) [n=22], such as tetracosane dioic acid $HOOC(CH_2)_{22}COOH$ (Aldrich 30,670-3); derivatives of malonic acid, such as (16) methyl malonic acid $HOOCCH(CH_3)COOH$ (Aldrich M5,405-8); (17) ketomalonic acid monohydrate $HOOCC(OH)_2$ COOH (Aldrich 16,343-0); (18) ethyl malonic acid $HOOC(C_2H_5)COOH$ (Aldrich 10,268-7); (19) diethyl malonic acid $HOOCC(C_2H_5)_2COOH$ (Aldrich 24,654-9); derivatives of succinic acid, such as (20) mercapto succinic acid $HOOCCH_2CH(SH)COOH$ (Aldrich M618-2); (21) methyl succinic acid $HOOCCH_2CH(CH_3)COOH$ (Aldrich M8,120-9); (22) malic acid $HOOCCH_2CH(OH)COOH$ (Aldrich M121-0); (23) 2,3-dimethyl succinic acid $HOOCCH(CH_3)CH(CH_3)COOH$ (Aldrich D18,620-1); (24) citramalic acid $HOOCCH_2C(CH_3)(OH)COOH$ (Aldrich 32,914-2); (25) (±)-cyclohexyl succinic acid $HOOCCH_2C(C_6H_{11})COOH$ (Aldrich 33,219-4); (26) (±)-2-(carboxymethyl thio) succinic acid $HOOCCH_2CH(SCH_2COOH)COOH$ (Aldrich 28,238-3); (27) tartaric acid $HOOCCH(OH)CH(OH)COOH$ (Aldrich T20-6, T40-0, T-10-9, 25,138-0); derivatives of glutaric acid, such as (28) 2,2-dimethyl glutaric acid $HOOCCH_2CH_2C(CH_3)_2COOH$ (Aldrich 20,526-5); (29) 2,4-dimethyl glutaric acid $HOOCCH(CH_3)CH_2CH(CH_3)COOH$ (Aldrich 23,941-0); (30) 3,3-dimethyl glutaric acid $HOOCCH_2C(CH_3)_2CH_2COOH$ (Aldrich D15,940-9); (31) 2-methyl glutaric acid $HOOCCH_2CH_2CH(CH_3)COOH$ (Aldrich 12,986-0); (32) 3-methyl glutaric acid $HOOCCH_2CH(CH_3)CH_2COOH$ (Aldrich M4,760-4); (33) 3,3-tetramethylene glutaric acid $HOOCCH_2C_5H_8CH_2COOH$ (Aldrich T2,190-3); (34) 3-phenyl glutaric acid $HOOCH_2CC_6H_5CHCH_2COOH$ (Aldrich P2,520-5); (35) 2-ketoglutaric acid $HOOCCH_2CH_2COCOOH$ (Aldrich K160-0); (36) 3-ketoglutaric acid $HOOCCH_2COCH_2COOH$ (Aldrich 16,511-5); derivatives of adipic acid, such as (37) 3-methyl adipic acid $HOOC(CH_2)_2CH(CH_3)CH_2COOH$ (Aldrich M2,740-9); derivatives of pimelic acid, such as (38) (±)-2,6-diamino pimelic acid $HOOCCH(NH_2)(CH_2)_3CH(NH_2)COOH$ (Aldrich 27,147-0); (39) 4-ketopimelic acid $HOOCCH_2CH_2COCH_2CH_2COOH$ (Aldrich K350-6); other derivatives, such as (40) mucic acid (galactaric acid) $HOOC(CHOH)_4COOH$ (Aldrich M8,961-7); (41) 3-methylene cyclopropane-trans-1,2-dicarboxylic acid $H_2C{=}C(CHCOOH)_2$ (Aldrich 22,053-1); (42) 1,1-cyclobutane dicarboxylic acid $C_4H_6(COOH)_2$ (Aldrich C9,580-3); (43) cyclohexane dicarboxylic acid $C_6H_{10}(COOH)_2$ (Aldrich 30,703-3, C10,075-7, 33,123-6); (b) compounds of the general formula $R(CH_2COOH)_2$ and their derivatives, wherein R is selected from the group consisting of imine, acetamido imine, alkylimine, oxo, and cycloalkane, including (1) when R=NH, such as imino diacetic acid $NH(CH_2COOH)_2$ (Aldrich 22,000-0); (2) $R{=}H_2NCOCH_2N$, such as [N-(2-acetamido) imino diacetic acid] $H_2NCOCH_2N(CH_2COOH)_2$ (Aldrich 85,760-2); (3) $R{=}CH_3N$, such as methyl iminodiacetic acid $CH_3N(CH_2COOH)_2$ (Aldrich M5,100-8); (4) R=0 (oxygen), such as diglycolic acid $0(CH_2COOH)_2$ (Aldrich 14,307-3); (5) $R{=}C_6H_{10}$, such as 1,1-cyclohexane diacetic acid $C_6H_{10}(CH_2COOH)_2$ (Aldrich 17,134-4); (c) compounds of the general formula $HOOC(CH_2)_nCH{=}CHCOOH$ and their derivatives, wherein n represents the number of repeating units, including (1) [n=0], such as fumaric acid HOOCCH=CHCOOH (Aldrich 24,074-5, F1 935-3); (2) maleic acid HOOC—CH=CH—COOH (Aldrich M15-3); (3) [n=1], such as glutaconic acid $HOOCCH_2CH{=}CHCOOH$ (Aldrich G260-5); (4) [n=8], such as 2-dodecenedioic acid $HOOC(CH_2)_8CH{=}CHCOOH$ (Aldrich 17,724-5); derivatives of fumaric or maleic acid, such as (5) mesaconic acid $HOOCCH{=}C(CH_3)COOH$ (Aldrich 13,104-6); (6) citraconic acid $HOOC(CH_3)C{=}CHCOOH$ (Aldrich C8,260-4); (7) dihydroxy fumaric acid hydrate $HOOCC(OH){=}C(OH)COOH.xH_2O$ (Aldrich D11,320-4); and other derivatives, such as (8) trans, trans-1,3-butadiene-1,4-dicarboxylic acid HOOCCH=CHCH=CHCOOH (Aldrich M9,000-3); and the like.

Additionally suitable in embodiments are aromatic dicarboxy-functional compounds, such as (1) homophthalic acid $HOOCCH_2C_6H_4COOH$ (Aldrich H1,620-5); (2) terephthalic acid $C_6H_4$-1,4-$(COOH)_2$ (Aldrich 18,536-1); (3) phthalic acid $C_6H_4$-1,2-$(COOH)_2$ (Aldrich P3,930-3); (4) 4-methyl phthalic acid $CH_3C_6H_3$-1,2-$(COOH)_2$ (Aldrich 34,830-9); (5) chelidonic acid monohydrate (Aldrich 12,495-8); (6) chelidamic acid monohydrate (Aldrich C1,820-5); (7) cis-5-norbornene-endo-2,3-dicarboxylic acid (Aldrich 21,670-4); (8) 1,4-naphthalene dicarboxylic acid $C_{10}H_6(COOH)_2$ (Aldrich 33,358-1); (9) 2,3-naphthalene dicarboxylic acid $C_{10}H_6(COOH)_2$ (Aldrich N40-0); (10) 2,6-naphthalene dicarboxylic acid $C_{10}H_6(COOH)_2$ (Aldrich 30,153-3); (11) 4-carboxy phenoxy acetic acid $HOOCC_6H_4OCH_2COOH$ (Aldrich 18,662-7); (12)2,5-dihydroxy-1,4-benzene diacetic acid $(HO)_2C_6H_2(CH_2COOH)_2$ (Aldrich D10,920-7); (13) pamoic acid [4,4'-methylene bis(3-hydroxy-2-naphthoic acid)] (Aldrich P9-4); (14) 4-[4-(2 -carboxybenzoyl) phenyl] butyric acid $HOOCC_6H_4COC_6H_4(CH_2)_3COOH$ (Aldrich 19,281-3); (15) 1,4-phenylene diacrylic acid $HOOCCH{=}CHC_6H_4CH{=}CHCOOH$ (Aldrich P2,390-3); (16) 2-carboxy cinnamic acid $HOOCC_6H_4CH{=}CHCOOH$ (Aldrich 18,603-1); (17) γ-L-glutamyl-L-cysteinylglycine $HOOCCH(NH_2)CH_2CH_2CONHCH(CH_2SH)CONHCH_2COOH$ (Aldrich G470-5); (18) D,L-isocitriclactone [DL-2-oxotetrahydrofuran-4,5-dicarboxylic acid (Aldrich I-1,600-5), (19) N-(2-hydroxyethyl) iminodiacetic acid $HOCH_2CH_2N(CH_2COOH)_2$ (Aldrich 15,814-3); (20) dipivaloyl-L-tartaric acid $[(CH_3)_3CCOOCH(COOH)-]_2$ (Aldrich 33,788-9); (21) (±)-cyclohexyl succinic acid $HOOCCH_2CH(C_6H_{11})COOH$ (Aldrich 33,219-4); (22) phenyl diacetic acid $C_6H_4(CH_2COOH)_2$ (Aldrich 13,140-7, P2,335-0, P2,340-7); and the like.

Also suitable are aliphatic and aromatic compounds with more than two —COOH functional groups, including (1) 1,3,5-cyclohexane tricarboxylic acid $C_6H_9(COOH)_3$ (Aldrich 34,434-6); (2) citric acid monohydrate $HOOCCH_2C(OH)(COOH)CH_2COOH.H_2O$ (Aldrich 24,752-9); (3) 1,2,3-propene tricarboxylic acid $HOOCCH{=}C(COOH)CH_2COOH$ (Aldrich 27,194-2); (4) 1,2,3-propane tricarboxylic acid $HOOCCH_2CH(COOH)CH_2COOH$ (Aldrich T-5,350-3); (5) β-methyl tricarballyic acid $HOOCCH_2C(CH_3)COOHCH_2COOH$ (Aldrich M8,520-4); (6) 1,2,3,4-cyclobutane tetracarboxylic acid $C_4H_4(COOH)_4$ (Aldrich 32,494-9); (7) 1,2-diaminocyclohexane- N,N,N'N'-tetraacetic acid hydrate $C_6H_{10}[N(CH_2COOH)_2].xH_2O$ (Aldrich 12581-4); (8) 1,6-diaminohexane-N, N, N'N'-tetraacetic acid hydrate $(HOOCCH_2)_2N(CH_2)_6N(CH_2COOH)_2.xH_2O$ (Aldrich 23,245-9); (9) 1,2,4,5-benzene tetracarboxylic acid $C_6H_2(COOH)_4$ (Aldrich B,400-7); (10) 1,4,5,8-naphthalene tetracarboxylic acid hydrate $C_{10}H_4(COOH)_4.xH_2O$ (Aldrich 13009-5); (11) penta diethylene triamine penta acetic acid $(HOOCCH_2)_2NCH_2CH_2(CH_2COOH)CH_2CH_2N(CH_2COOH)_2$ (Aldrich 28,556-0, D9,390-2); (12) mellitic acid $C_6(COOH)_6$ (Aldrich M270-5); (13) agaricic acid (2-hydroxy-1,2,3-nonadecane tricarboxylic acid) $CH_3(CH_2)_{15}CH(COOH)C(OH)(COOH)CH_2COOH$ (Aldrich 21,783-2); (14) 1,2-diamino propane-N,N,N',N'-tetra acetic acid $(HOOCCH_2)NCH(CH_3)CH_2N(CH_2COOH)_2$ (Aldrich 15,813-5); (15) ethylene diamine tetraacetic acid $(HOOCCH_2)_2NCH_2CH_2N(CH_2COOH)_2$ (Aldrich 25,404-5); (16) (±)-2-(caraboxymethylthio) succinic acid $HOOCCH_2CH(SCH_2COOH)COOH$ (Aldrich 28,238-3); (17) N-(2-hydroxyethyl) ethylene diamine triacetic acid $HOCH_2CH_2N(Ch_2COOH)CH_2CH_2N(CH_2COOH)_2$ (Aldrich H2,650-1 ); (18) N,N'-bis(2-carboxyethyl)-N,N'-ethylene diglycine trihydrate $[—CH_2N(CH_2COOH)CH_2CH_2COOH]_2.3H_2O$; (19) tetrahydrofuran-2,3,4,5-tetracarboxylic acid (Aldrich 14,483-5); and the like.

In addition, the second layer may contain lightfastness inducing agents containing UV absorbing compounds in amounts, for example, of from about 1 to about 3 pars, or weight percent, including glycerol ρ-amino benzoate, available as Escalol 106 from Van Dyk Corporation; resorcinol mono benzoate, available as RBM from Eastman Chemicals; octyl dimethyl amino benzoate, available as Escalol 507 from Van Dyk Corporation; hexadecyl 3,5-di-tert-butyl-4-hydroxy-benzoate, available as Cyasorb UV-2908, #41,320-8, from Aldrich Chemical Company; octyl salicylate, available as Escalol 106 from Van Dyk Corporation; octyl methoxy cinnamate, available as Parasol MCX from Givaudan Corporation; 4-allyloxy-2-hydroxybenzophenone, available as Uvinul 600, #41,583-9, from Aldrich Chemical Company; 2-hydroxy-4-methoxy benzophenone, available as Anti UVA, from Acto Corporation; 2,2'-dihydroxy-4,4'-dimethoxy benzophenone, available as Uvinul D 49, #D11,100-7, from Aldrich Chemical Company; 2-hydroxy-4-(octyloxy)benzophenone, available as Cyasorb UV-531, #41,315-1, from Aldrich Chemical Company; 2-hydroxy-4-dodecyloxy benzophenone, available as DOBP from Eastman Chemicals; 2-(2'-hydroxy-5'-methylphenyl)benzotriazole, available as Tinuvin 900 from Ciba Geigy Corporation; 2-[2'-hydroxy-3,5-di-(1,1-dimethyl benzyl)phenyl]-2H-benzotriazole, available as Topanex 100BT from ICI America Corporation; bis[2-hydroxy-5-tert-octyl-3-(benzotriazol-2-yl) phenyl methane, available as Mixxim BB/100 from Fairmount Corporation; 2-(3',5'-di-tert-butyl-2'-hydroxyphenyl)-5-chlorobenzotriazole, available as Tinuvin 327 from Ciba Geigy Corporation; 2-(4-benzoyl-3-hydroxyphenoxy) ethylacrylate (Cyasorb UV-416, #41,321-6, available from Aldrich Chemical Company), poly[2-(4-benzoyl-3-hydroxyphenoxy)ethylacrylate] (Cyasorb UV-2126, #41,323-2, available from Aldrich Chemical Company), N-(p-ethoxycarbonyl phenyl)-N'-ethyl-N'-phenyl formadine, available as Givesorb UV-2 from Givaudan Corporation; 1,1-(1,2-ethane-diyl) bis(3,3,5,5-tetramethyl piperazinone), available as Good-rite UV 3034 from Goodrich Chemicals; tris(3,5-di-tert-butyl-4-hydroxybenzyl)isocyanurate, available as Good-rite UV 3114 from Goodrich Chemicals; nickel bis(o-ethyl(3,5-di-tert-butyl-4-hydroxybenzyl) phosphonate, available as Irgastab 2002 from Ciba Geigy Corporation; [2,2,6,6-tetramethyl-4-piperidinyl)-1,2,3,4-butane tetracarboxylate available as Mixxim HALS 57 from Fairmount Corporation; [2,2,6,6-tetramethyl-4-piperidinyl/β,β,β',β'-tetramethyl-3,9-(2,4,8,10-tetraoxospiro (5,5) undecane)diethyl]-1,2,3,4-butane tetracarboxylate, available as Mixxim HALS 68 from Fairmount Corporation; [1,2,2,6,6- pentamethyl-4-piperidinyl/β,β,β',β'-tetramethyl-3,9-(2,4,8,10-tetraoxospiro (5,5) undecane)diethyl]-1,2,3,4-butane tetracarboxylate, available as Mixxim HALS 63 from Fairmount Corporation; 2-dodecyl-N-(2,2,6,6-tetramethyl-4-piperidinyl) succinimide, available as Cyasorb UV-3581, #41,317-8, from Aldrich Chemical Company); 2-dodecyl-N-(1,2,2,6,6-pentamethyl-4-piperidinyl) succinimide, available as Cyasorb UV-3604, #41,318-6, from Aldrich Chemical Company; N-(1-acetyl-2,2,6,6-tetramethyl-4-piperidinyl)-2-dodecyl succinimide, available as Cyasorb UV-3668, #41,319-4, from Aldrich Chemical Company; tetra sodium N-(1,2-dicarboxyethyl)-N-octadecyl sulfosuccinamate, available as Aerosol 22N from American Cyanamid Corporation; nickel dibutyldithiocarbamate, available as UV-Chek AM-105 from Ferro Corporation; poly(4-hydroxy-2,2,6,6-tetramethyl-1-piperidine ethanol/dimethyl succinic acid), available as Tinuvin 622LD from Ciba-Geigy Corporation; poly(3,5-di-tert-butyl-4-hydroxy hydrocinnamic) acid ester/1,3,5-tris(2-hydroxyethyl)-5-triazine-2,4,6(1H,3H,5H)-trione, available as Good-rite 3125 from Goodrich Chemicals; poly[N,N-bis(2,2,6,6-tetramethyl-4-piperidinyl)-1,6-hexanediamine-co-2,4-dichloro-6-morpholino-1,3,5-triazine], available as Cyasorb UV-3346, #41,324-0, from Aldrich Chemical Company; 1-[N -[poly(3-allyloxy-2-hydroxypropyl)-2-aminoethyl]-2-imidazolidinone], #41,026-80 available from Aldrich Chemical Company; and poly(2-ethyl-2-oxazoline) #37,284-6, #37,285-4, #37,397-4, available from Aldrich Chemical Company.

Further, the second layer may contain lightfastness inducing antioxidant compounds in amounts, for example, of from about 1 to about 3 parts or weight percent, such as didodecyl 3,3'-thiodipropionate, available as Cyanox, LTDP, #D12,840-6, from Aldrich Chemical Company; ditridecyl 3,3'-thiodipropionate, available as Cyanox 711, #41,311-9, from Aldrich Chemical Company; ditetradecyl 3,3'-thiodipropionate, available as Cyanox, MTDP, #41,312-7, from Aldrich Chemical Company; dicetyl 3,3'-thiodipropionate, available as Evanstab 16 from Evans Chemetics Corporation; dioctadecyl 3,3'-thiodipropionate, available as Cyanox, STDP, #41,310-0, from Aldrich Chemical Company; triethyleneglycol bis[3-(3'-tert -butyl-4'-hydroxy-5'-methylphenyl)propionate], available as Irganox 245 from Ciba-Geigy Corporation; octadecyl 3-(3,5-di-tert-butyl-4-hydroxyphenyl)propionate, available as Ultranox 276 from General Electric Company; 1,6-hexamethylene bis(3,5-di-tert-butyl-4-hydroxy hydrocinnamate), available as Irganox 259 from Ciba-Geigy Corporation; tetrakis[methylene(3,5-di-tert-butyl-4-hydroxy hydrocinnamate)], available as Irganox 1010 from Ciba-Geigy Corporation; thiodiethylenebis(3,5-di-tert-butyl-4-hydroxy) hydrocinnamate, available as Irganox 1035 from Ciba-Geigy Corporation; octadecyl 3,5-di-tert-butyl-4-hydroxy hydrocinnamate, available as Irganox 1076 from Ciba-Geigy Corporation; N,N'-hexamethylenebis(3,5-di-tert-butyl-4-hydroxy hydrocinnamide), available as Irganox 1098 from Ciba-Geigy Corporation; 2,2-bis[4-(2-(3,5-di-tert -butyl-4-hydroxyhydrocinnamoyloxy))ethoxy phenyl] propane, available as Topanol 205 from ICI America Corporation; N-stearoyl-ρ-aminophenol, available as Sucnox-18 from Hexcel Corporation; 2,6-di-tert-butyl-4-methyl phenol, available as Ultranox 226 from General Electric Company; 2,6-di-tert-butyl-ρ-cresol, available as Vulkanox KB from Mobay Chemicals; 2,6-di-tert-butyl-α-dimethylamino-ρ-cresol, available as Ethanox 703 from Ethyl Corporation; 2,2'-isobutylidene-bis(4,6-dimethyl phenol), available as Vulkanox NKF from Mobay Chemicals; 2,2'-methylene bis(6-tert-butyl-4-methylphenol), available as Cyanox 2246, #41,315-5, from Aldrich Chemical Company; 2,2'-methylene bis(6-tert-butyl-4-ethylphenol), available as Cyanox 425, #41,314-3, from Aldrich Chemical Company; tris(4-tert-butyl-3-hydroxy-2,6-dimethylbenzyl) isocyanurate, available as Cyanox 1790, #41,322-4, LTDP, #D12,840-6, from Aldrich Chemical Company; 1,3,5-trimethyl-2,4,6-tris(3,5-di-tert-butyl-4-hydroxybenzyl) benzene, available as Ethanox 300, #41,328-3, from Aldrich Chemical Company; triphenyl phosphite, available as Lankromark LF65 from Harcros Corporation; tris(nonyl phenyl) phosphite, available as Lankromark LE109 from Harcros Corporation; tris(2,4-di-tert-butyl-phenyl)phosphite, available as Wytox 240 from Olin Corporation; 2,2'-ethylidene bis(4,6-di-tert-butylphenyl) fluorophosphonite, available as Ethanox 398 from Ethyl Corporation; octylated diphenylamine, available as Anchor ODPA from Anchor Corporation; N,N'-β,β'-naphthalene-ρ-phenylenediamine, available as Anchor DNPD from Anchor Corporation; 4,4'-methylene-bis(dibutyldithio carbamate), available as Vanlube 7723 from Vanderbilt Corporation; antimony dialkyldithio carbamate, available as Vanlube 73 from Vanderbilt Corporation; antimony dialkylphosphorodithioate, available as Vanlube 622 from Vanderbilt Corporation; molybdenum oxysulfide dithio carbamate, available as Vanlube 622 from Vanderbilt Corporation; 2,2,4-trimethyl-1,2-hydroquinoline, available as Vulkanox HS from Mobay Corporation; and mixtures thereof.

The second layer may also contain lightfastness inducing antiozonants in amounts, for example, of from 1 to about 3 parts, or weight percent, such as N-isopropyl-N'-phenylphenylene diamine, available as Santoflex IP from Monsanto Chemicals; N-(1,3-dimethylbutyl)-N'-phenyl-phenylene diamine, available as Santoflex 13 from Monsanto Chemicals; N,N'-di(2-octyl)-ρ-phenylene diamine, available as Antozite-1 from Vanderbilt Corporation; N,N'-bis(1,4-dimethyl pentyl)-ρ-phenylene diamine, available as Santoflex 77 from Monsanto Chemicals; 2,4,6-tris-(N-1,4-dimethyl pentyl-ρ-phenylene diamino)-1,3,5-triazine, available as Durazone 37 from Uniroyal Corporation; 6-ethoxy-1,2-dihydro-2,2,4-trimethyl quinoline, available as Santoflex AW, from Monsanto Chemicals; bis-(1,2,3,6-tetrahydrobenzaldehyde) pentaerythritol acetal, available as Vulkazon AFS/LG from Mobay Corporation; paraffin wax, available as Petrolite C-700, Petrolite C-1035 from Petrolite Corporation; and mixtures thereof. Thus, the lightfastness inducing agent can be comprised of a mixture of UV absorber, antioxidant, and antiozonant.

A biocide for the second layer can be the same as, or similar to the biocide of the first layer coating. Examples of fillers include collidal silicas available from W. R. Grace, and such fillers are present in effective amounts to assist in the feeding of the transparency through the printer, for example from about 0.1 to about 10 weight percent, and preferably from 1 to about 5 weight percent.

Examples of the waterfastness dye mordants include quaternary acrylic copolymers including polymers such as polymethyl acrylate trimethyl ammonium chloride latex, such as HX42-1 available from Interpolymer Corporation, or the like; formaldehyde-free GARDOL DR/NF™ available from Apollo Chemical Corporation, polyquaternary amine PERCHEM 553™ available from Chem Link Industrial, polyquaternary amine POLY PLUS 1290™ available from Betz Paper Chem Inc; ARMOSOFT 420-90™ available from Akzo Chemie Chemicals, Mirapol A-15 and MirapoL WT available from Miranol, Incorporated, Dayton, N.J., prepared as disclosed in U.S. Pat. No. 4,157,388, the disclosure of which is totally incorporated herein by reference, Mirapol AZ-1 available from Miranol, Inc., prepared as disclosed in U.S. Pat. No. 4,719,282, the disclosure of which is totally incorporated herein by reference, Mirapol AD-1 available from Miranol, Inc., prepared as disclosed in U.S. Pat. No. 4,157,388, Mirapol 9, Mirapol 95, and Mirapol 175 available from Miranol, Inc., Dayton, N.J., prepared as disclosed in U.S. Pat. No. 4,719,282, and the like. Other suitable cationic dye mordants comprise diamino alkanes; quaternary salts; quaternary acrylic copolymer latexes; ammonium quaternary salts as disclosed in U.S. Pat. No. 5,320,902, such as tetramethyl ammonium bromide (Aldrich 19,575-8), tetrahexyl ammonium hydrogen sulfate (Fluka 87299), hexamethylene bistrimethyl ammonium bromide (Aldrich 21,967-3); 2-hydroxypropyl-bis-1,3-(N-isostearyl amido propyl-N,N-dimethyl ammonium chloride) (Schercoquat 21AP, Scher Chemicals), ricinoleamidopropyl ethyl dimonium ethosulfate (Lipoquat R., Lipo Chemicals), benzyl tallow dimethyl ammonium chloride (Kernamine BQ-9742C from Witco Chemicals), myristyl trimethyl ammonium bromide (Aldrich 86,042-5), Cetrimide BP Triple Crown America, and the like; phosphonium quaternary salts as disclosed in copending application U.S. Ser. No. 08/034,917, such as methyl triphenyl phosphonium bromide (Aldrich 13,007-9), methyl triphenyl phosphonium iodide (Aldrich 24,505-4), ethyl triphenyl phosphonium bromide (Aldrich E5,060-4), n-propyl triphenyl phosphonium bromide (Aldrich 13,156-3), isopropyl triphenyl phosphonium iodide (Aldrich 37,748-1), cyclopropyl triphenyl phosphonium bromide (Aldrich 15,731-7), hexadecyl tributyl phosphonium bromide (Aldrich 27,620-0), stearyl tributyl phosphonium bromide (Aldrich 29,303-2), tetramethyl phosphonium bromide (Aldrich Chemical Company 28,826-8), tetramethyl phosphonium chloride (Aldrich 28,827-6), tetraethyl phosphonium bromide (Aldrich 33,365-4), tetraethyl phosphonium chloride (Aldrich 32,539-2), tetraethyl phosphonium iodide (Aldrich 32,540-6), tetrabutyl phosphonium bromide (Aldrich 18,913-8), tetrabutyl phosphonium chloride (Aldrich 14,480-0), and the like, as well as mixtures thereof; and sulfonium, thiazolium and benzothiazolium quaternary salts as disclosed in U.S. Pat. No. 5,314,747, the disclosures of each of which are totally incorporated herein by reference.

The coatings of the present invention can be applied to the substrate by any suitable technique. For example, the layer coatings can be applied by a number of known techniques, including melt extrusion, reverse roll coating, solvent extrusion, and dip coating processes. In dip coating, a web of material to be coated is transported below the surface of the coating material (which generally is dissolved in a solvent) by a single roll in such a manner that the exposed site is saturated, followed by the removal of any excess coating by a blade, bar, or squeeze roll; the process is then repeated with the appropriate coating materials for application of the other layered coatings. With reverse roll coating, the premetered coating material (which generally is dissolved in a solvent) is transferred from a steel applicator roll onto the web material to be coated. The metering roll is stationary or is rotating slowly in the direction opposite to that of the applicator roll. In slot extrusion coating, a flat die is used to apply coating material (which generally is dissolved in a solvent) with the die lips in close proximity to the web of material to be coated. Once the desired amount of coating has been applied to the web, the coating is dried, typically at from about 25 to about 100° C. in an air dryer.

One embodiment of the present invention includes a transparency with a first layer coating of a thickness of 10 microns, and comprised of 50.0 percent by weight of the super absorbent acrylic copolymer DP6-7132, from Allied Colloids, 49 percent by weight of a second ink absorber like hydroxyethyl methyl cellulose (HE M, available from British Celanese Ltd.), or other similar known ink absorbers, and 1 percent by weight of the biocide compound 2-hydroxypropylmethane thiosulfonate (Busan 1005, available from Buckman Laboratories Inc.); and a second 5 micron thick ink spreading layer situated on the top of the 10 micron thick first layer comprised of 50 percent by weight of polyvinyl alcohol, 88 percent hydrolyzed, available as Airvol 540-S from Air Products Company, 20 percent by weight of 3,5-dihydroxy benzoic acid (Aldrich #D11,000-0), 24.9 percent by weight of a dye mordant polymethyl acrylate trimethyl ammonium chloride latex, HX42-1 available from Interpolymer Corporation, 3.0 percent by weight of poly[N,N-bis(2,2,6,6-tetramethyl-4 -piperidinyl)-1,6-hexanediamine-co-2,4-dichloro-6-morpholino-1,3,5-triazine (Cyasorb UV-3346, #41,324-0, available from Aldrich Chemical Company), and 2.0 percent by weight of didodecyl 3,3'-thiodipropionate, and 0.1 percent by weight of colloidal silica, available as Syloid 74 from W. R. Grace. This transparency has a haze value of 2, lightfast values of greater than 95 percent, and waterfastness of greater than 75 percent. The transparencies of the present invention in embodiments can also be used in a printing or imaging process, such as printing with pen plotters, handwriting with ink pens, offset printing processes, or the like, provided that the ink employed to form the image is compatible with the ink receiving layer of the transparency.

The drying time of images obtained with the transparencies of the present application is the time for zero image-offset and can be measured as follows: a line comprising different color sequences is drawn on the transparency with droplets of inks from an ink jet printhead moving from left to right and back. Thereafter, this image is purposely smeared with the pinch roll of the printer by fast forwarding the transparency mechanically while the pinch roll is on the top of the imaged line. This entire procedure takes about two seconds to complete. In the event that no offset of the printed image on the unprinted paper or transparency occurs, the drying time of the image is considered as less than two seconds.

Transparencies of the present invention in embodiments exhibit reduced curl upon being printed with aqueous inks, particularly in situations wherein the ink image is dried by exposure to microwave radiation. Generally, the term "curl" refers to the distance between the base line of the arc formed by the transparency or recording sheet when viewed in cross-section across its width (or shorter dimension, for example, 8.5 inches in an 8.5×11 inch sheet, as opposed to length, or longer dimension, for example, 11 inches in an 8.5×11 inch sheet) and the midpoint of the arc. To measure curl, a sheet can be held with the thumb and forefinger in the middle of one of the long edges of the sheet (for example, in the middle of one of the 11 inch edges in an 8.5×11 inch sheet) and the arc formed by the sheet can be matched against a pre-drawn standard template curve.

The transparencies of the present invention in embodiments exhibit little or no blocking. Blocking refers to the transfer of ink or toner from a printed image from one sheet to another when recording sheets are stacked together. The recording sheets of the present invention exhibit substantially no blocking under, for example, environmental conditions of from about 20 to about 80 percent relative humidity and at temperatures of about 80° F.

Transparencies of the present invention in embodiments exhibit high resistance to humidity. Resistance to humidity generally is the capacity of a recording sheet to control the blooming and bleeding of printed images, wherein blooming represents intra-diffusion of dyes and bleeding represents inter-diffusion of dyes. The blooming test can be performed by printing a bold filled letter such as "T" on a recording sheet and placing the sheet in a constant environment chamber preset for humidity and temperature. The vertical and horizontal spread of the dye in the letter "T" is monitored periodically under a microscope. Resistance to humidity limit is established when the dyes selected begin to diffuse out of the letter "T". The bleeding test is performed by printing a checker board square pattern of various different colors and measuring the inter-diffusion of colors as a function of humidity and temperature.

The optical density measurements recited herein were obtained on a Pacific Spectrograph Color System. The system consists of two major components, an optical sensor and a data terminal. The optical sensor employs a 6 inch integrating sphere to provide diffuse illumination and 8 degrees viewing. This sensor can be used to measure both transmission and reflectance samples. When reflectance samples are measured, a specular component may be included. A high resolution, full dispersion, grating monochromator was used to scan the spectrum from 380 to 720 nanometers. The data terminal features a 12 inch CRT display, numerical keyboard for selection of operating parameters and the entry of tristimulus values, and an alphanumeric keyboard for entry of product standard information.

Haze values recited herein were measured by a XL-211 Hazegard Hazemeter supplied by Pacific Scientific Company.

The lightfastness values of the ink jet images were measured in the Mark V Lightfastness Tester obtained from Microscal Company, London, England.

The spot size measurements recited herein were measured on printed patterns of spots using a high resolution CCD Camera available as EDC-1000 HR from Electrim Corporation and equipped with a zoom lens microscope, an illuminator and appropriate filters. The spot patterns were captured by the computer and analyzed with a high speed Pentium Computer using custom Xerox software package to measure approximately sixty spots each time. The average, standard deviation, and height/width ratio were calculated.

Specific embodiments of the invention will now be described in detail. These Examples are intended to be illustrative, and the invention is not limited to the materials, conditions, or process parameters set forth in these embodiments. The coatings, a total of four, are included on both surfaces or sides of the transparency unless otherwise indicated. All parts and percentages are by weight unless otherwise indicated.

EXAMPLE I

(COMPARATIVE)

Twenty transparency sheets were prepared by the solvent extrusion process (single side each time initially) on a Faustel Coater using a two slot die by providing for each a MYLAR™ base sheet (roll form) with a thickness of 100 microns, and coating the base sheet simultaneously with two hydrophilic polymeric layers where the first 10 micron ink absorbing layer in contact with the substrate was comprised of a blend comprised of 50 parts of the super absorbent acrylic acid-acrylamide copolymer, #18545 available from Poly Sciences Inc., 49 parts by weight of a second ink absorber hydroxyethyl methyl cellulose (HEM available from British Celanese Ltd.), and 1 part by weight of the biocide compound 2-hydroxypropylmethane thiosulfonate (Busan 1005 available from Buckman Laboratories Inc.) which blend was present in a concentration of 5 percent by weight in water, and a second 5 micron thick layer situated on the top of the 10 micron thick first layer, and which second layer is comprised of 75 parts by weight of polyvinyl alcohol (88 percent hydrolyzed, available as Airvol 540-S from Air Products Company), 24.9 parts by weight of the dye mordant polymethyl acrylate trimethyl ammonium chloride, HX42-1 available from Interpolymer Corporation, 0.1 part by weight of colloidal silica filler, available as Syloid 74 from W.R. Grace and Company, which blend was present in a concentration of 4 percent by weight in water. Subsequent to air drying at 100° C. and monitoring the difference in weight prior to and subsequent to coating, the dried MYLAR™ base sheet rolls contained 1.5 grams in a thickness of 15 microns of the two layered transparency structure. Rewinding the coated side of the MYLAR™ base sheet (roll form) on to an empty core and using these rolls, the uncoated side of the MYLAR™ base sheet was coated on a Faustel Coater using a two slot die simultaneously with two hydrophilic polymeric layers where the first layer in contact with the substrate was a blend of 50 parts by weight of the super absorbent acrylic acid-acrylamide copolymer, #18545 available from Poly Sciences Inc., 49 parts by weight of a second ink absorber hydroxyethyl methyl cellulose (HEM available from British Celanese Ltd.), and 1 part by weight of the biocide compound 2-hydroxypropylmethane thiosulfonate (Busan 1005 available from Buckman Laboratories Inc.), which blend was present in a concentration of 5 percent by weight in water, and a second 5 micron thick ink spreading layer situated on the top of the 10 micron thick first layer comprised of 75 parts by weight of polyvinyl alcohol (88 percent hydrolyzed, available as Airvol 540-S from Air Products Company), 24.9 parts by weight of dye mordant polymethyl acrylate trimethyl ammonium chloride. HX42-1 available from Interpolymer Corporation, 0.1 part by weight of colloidal silica filler, available as Syloid 74 from W. R. Grace and Company, which blend was present in a concentration of 4 percent by weight in water. Subsequent to air drying at 100° C. and monitoring the difference in weight prior to and subsequent to coating, the dried MYLAR™ base sheet rolls contained 1.5 grams in a thickness of 15 microns of the two layered transparency structure. The transparency sheets thus prepared had a haze value of 0.6.

The above prepared transparencies were printed on a Xerox Test Fixture for spot size measurements using inks of the following compositions:

Cyan:

15.75 percent by weight of sulfolane, 12.0 percent by weight of butyl carbitol, 2.0 percent by weight of ammonium bromide, 13.0 percent by weight of acetylethanolamine, 0.015 percent by weight of ammonium hydroxide, 0.05 percent by weight of polyethylene oxide (molecular weight 18,500), obtained from Union Carbide Company, 22.5 percent by weight of Projet Cyan 1 dye, obtained from Zenca Colors, 18.75 percent by weight of Projet Blue OAM dye, obtained from Zenca Colors, and 15.935 percent by weight of deionized water.

Black:

Twenty percent by weight of sulfolane, 6.0 percent by weight of trimethylolpropane, 1.25 percent by weight of ammonium formate, 0.05 percent by weight of DOWICIL 150 biocide, obtained from Dow Chemical Company, Midland, MI, 0.05 percent by weight of polyethylene oxide (molecular weight 18,500), obtained from Union Carbide Company, 17.0 percent by weight of Basacid Black NB X 34, obtained from BASF, 3.0 percent by weight of Direct Red 227, obtained from Tricon Colors, and 52.65 percent by weight of deionized water.

The average diameter (spot size) of ink on the ink receiving layer comprising polyvinylalcohol, the dye mordant, and silica was found to be 63.9±3.4 microns for the cyan color, and 66.4±2.3 microns for the black color.

EXAMPLE II

Two hundred transparency sheets (twenty with each acid) were prepared in a manner similar to that described in Example I except that the ink spreading, or second ink coating layer now contained different hydroxy acids in combination with the dye mordant and the polyvinyl alcohol. The ink spreading layer was now comprised of 65 parts by weight of polyvinyl alcohol (88 percent hydrolyzed, available as Airvol 540-S from Air Products Company), 24.9 parts by weight of a dye mordant polymethyl acrylate trimethyl ammonium chloride, HX42-1 available from Interpolymer Corporation, 0.1 part by weight of colloidal silica, available as Syloid 74 from W.R. Grace and Company, and 10.0 parts by weight of an acid. The ten acids selected were as follows: (1) 2-hydroxybenzoic acid, (2) 3-hydroxybenzoic acid, (3) 2,4-dihydroxybenzoic acid, (4) 2,5-dihydroxybenzoic acid, (5) 2,6-dihydroxybenzoic acid, (6) 3,5-dihydroxybenzoic acid, (7) 2,4,6-trihydroxybenzoic acid, (8) 3,4,5-trihydroxybenzoic acid, (9) 1,3,5-tris(2-hydroxyethyl)cyanuric acid, and (10) boric acid.

The average diameter (spot size) of cyan ink having the same composition as those used in Example I on the inkspreading layer comprising polyvinylalcohol, hydroxy acid, the dye mordant and silica was found to be (1) 2-hydroxybenzoic acid, 68.9±3.2 microns, (2) 3-hydroxybenzoic acid, 66.5±2.5 microns, (3) 2,4-dihydroxybenzoic acid, 71.0±1.2 microns, (4) 2,5-dihydroxybenzoic acid, 72.0±2.4 microns, (5) 2,6-dihydroxybenzoic, 67.0±1.4 microns, (6) 3,5-dihydroxybenzoic acid, 68.2±2.6 microns, (7) 2,4,6-trihydroxybenzoic acid, 65.8±2.7 microns, (8) 3,4,5-trihydroxybenzoic acid, 66.4±3.5 microns, (9) 1,3,5-tris(2-hydroxyethyl)cyanuric acid, 64.7±2.5 microns, and (10) boric acid, 70.5±3.8 microns. These values are higher than that 63.9±3.4 microns obtained in Example I when no acid was used in combination with polyvinylalcohol.

The average diameter (spot size) of black ink having the same composition as those used in Example I on the ink spreading layer comprising polyvinylalcohol, hydroxy acid, the dye mordant and silica was found to be (1) 2-hydroxybenzoic acid, 67.3±2.9 microns, (2) 3-hydroxybenzoic acid, 66.6±2.4 microns, (3) 2,4-dihydroxybenzoic acid, 69.8±2.5 microns, (4) 2,5-dihydroxybenzoic acid, 66.1±3.0 microns, (5) 2,6-dihydroxybenzoic, 67.4±3.7 microns, (6) 3,5-dihydroxybenzoic acid, 67.9±4.1 microns, (7) 2,4,6-trihydroxybenzoic acid, 67.7±2.4 microns, (8) 3,4,5-trihydroxybenzoic acid, 63.8±2.5 microns, (9) 1,3,5-tris(2-hydroxyethyl)cyanuric acid, 66.4±2.7 microns, and (10) boric acid, 69.6±2.3 microns.

The above haze values of all ten types of transparencies containing the above components were less than 1.

EXAMPLE III

Eighty transparency sheets were prepared in a manner similar to that described in Example II except that the ink spreading layer now contained 3,5-dihydroxy benzoic acid, but in different concentrations, in combination with the dye mordant and the polyvinyl alcohol. The ink spreading layer was now comprised of from 55 parts by weight to 70 parts by weight of polyvinyl alcohol (88 percent hydrolyzed, available as Airvol 540-S from Air Products Company) from 20 parts by weight to 5 parts by weight of 3,5-dihydroxy benzoic acid, 24.9 parts by weight of the dye mordant polymethyl acrylate trimethyl ammonium chloride, HX42-1 available from Interpolymer Corporation, and 0.1 part by weight of the filler colloidal silica, available as Syloid 74 from W.R. Grace and Company, The average diameter (spot size) of cyan ink having the same composition as those used in Example I on the ink spreading layer comprising polyvinylalcohol, 3,5-dihydroxybenzoic acid, the dye mordant and silica was found to be (1) 0.0 percent of 3,5-dihydroxybenzoic acid, 63.9 ±3.4 microns [from Example I], (2) 5.0 percent of 3,5-dihydroxybenzoic acid, 65.4±2.6 microns, (3) 10.0 percent of 3,5-dihydroxybenzoic acid, 68.2 ±2.6 microns, (4) 15.0 percent of 3,5-dihydroxybenzoic acid, 70.3±2.1 microns, and (5) 20.0 percent of 3,5-dihydroxybenzoic acid, 75.3±2.4 microns.

The average diameter (spot size) of black ink having the same composition as those used in Example I on the ink spreading layer comprising polyvinylalcohol, 3,5-dihydroxybenzoic acid, the dye mordant and silica was found to be (1) 0.0 percent of 3,5-dihydroxybenzoic acid, 66.4 ±2.3 microns [from Example I], (2) 5.0 percent of 3,5-dihydroxybenzoic acid, 68.8±3.5 microns, (3) 10.0 percent of 3,5-dihydroxybenzoic acid, 67.9 ±4.1 microns, (4) 15.0 percent of 3,5-dihydroxybenzoic acid, 69.8±2.5 microns, and (5) 20.0 percent of 3,5-dihydroxybenzoic acid, 69.1±3.0 microns.

The spot size for the cyan ink increases with increasing concentration of the acid within the range studied. The spot size for the black ink also increases with increasing concentration of the acid but reaches a maximum at about 15 percent concentration and then levels off. The haze values of transparencies containing 0.0, 5.0, 10.0, 15.0, or 20.0 percent acids was 0.6, 0.7, 0.9, 1.4, or 3.2, respectively, which are all in the acceptable range.

EXAMPLE IV

Twenty transparency sheets were prepared by the solvent extrusion process (single side each time initially) on a Faustel Coater using a two slot die by providing for each a MYLAR™ base sheet (roll form) with a thickness of 100 microns, and coating the base sheet simultaneously with two hydrophilic polymeric layers, 10 microns in total thickness, hydrophilic layer in contact with the substrate was comprised of a blend comprised of 50 parts of the super absorbent acrylic acid-acrylamide copolymer, #18545 available from Poly Sciences Inc., 49 parts by weight of a second ink absorber hydroxyethyl methyl cellulose (HEM available from British Celanese Ltd.), and 1 part by weight of the biocide compound 2-hydroxypropylmethane thiosulfonate (Busan 1005 available from Buckman Laboratories Inc.), which blend was present in a concentration of 5 percent by weight in water, and a second 5 micron thick ink spreading coating layer situated on the top of the 10 micron thick first layer, and which second layer was comprised of 55 parts by weight of polyvinyl alcohol, 88 percent hydrolyzed, available as Airvol 540-S from Air Products Company, 20 parts by weight of 3,5-dihydroxy benzoic acid (Aldrich #D11,000-0), and 24.9 parts by weight of the dye mordant polymethyl acrylate trimethyl ammonium chloride, HX42-1 available from Interpolymer Corporation, and 0.1 part by weight of colloidal silica, available as Syloid 74 from W.R. Grace and Company, which blend was present in a concentration of 4 percent by weight in water. Subsequent to air drying at 100° C. and monitoring the difference in weight prior to and subsequent to coating, the dried MYLAR™ base sheet rolls contained 1.5 grams in a thickness of 15 microns of the two layered transparency coating structure. Rewinding the coated side of the MYLAR™ base sheet (roll form) on to an empty core and using these rolls, the uncoated side of the MYLAR™ base sheet was coated on a Faustel Coater using a two slot die simultaneously with two hydrophilic polymeric layers where the first layer in contact with the substrate was a blend of 50 parts of the super absorbent acrylic acid-acrylamide copolymer, #18545 available from Poly Sciences Inc., 49 parts by weight of a second ink absorber of hydroxyethyl methyl cellulose (HEM available from British Celanese Ltd.), and 1 part by weight of the biocide compound 2-hydroxypropylmethane thiosulfonate (Busan 1005 available from Buckman Laboratories Inc.), which blend was present in a concentration of 5 percent by weight in water, and a second 5 micron thick ink spreading layer situated on the top of the 10 micron thick first layer and comprised of 55 parts by weight of polyvinyl alcohol, 88 percent hydrolyzed, available as Airvol 540-S from Air Products Company, 20 parts by weight of 3,5-dihydroxy benzoic acid (Aldrich #D11,000-0), and 24.9 parts by weight of the dye mordant polymethyl acrylate trimethyl ammonium chloride, HX42-1 available from Interpolymer Corporation, and 0.1 part by weight of colloidal silica, available as Syloid 74 from W.R. Grace and Company, which blend was present in a concentration of 4 percent by weight in water. Subsequent to air drying at 100° C. and monitoring the difference in weight prior to and subsequent to coating, the dried MYLAR™ base sheet rolls contained 1.5 grams in a thickness of 15 microns of the two layered transparency structure. The transparency sheets thus prepared had a haze value of 3.2.

These transparencies were incorporated into a Hewlett-Packard 500-C color ink jet printer containing inks of the following compositions:

Cyan:

15.75 percent by weight of sulfolane, 12.0 percent by weight of butyl carbitol, 2.0 percent by weight of ammonium bromide, 13.0 percent by weight of acetylethanolamine, 0.015 percent by weight of ammonium hydroxide, 0.05 percent by weight of polyethylene oxide (molecular weight 18,500), obtained from Union Carbide Company, 22.5 percent by weight of Projet Cyan 1 dye solution, obtained from Zenca Colors, 18.75 percent by weight of Projet Blue OAM dye solution, obtained from Zenca Colors, and 15.935 percent by weight of deionized water.

Magenta:

15.75 percent by weight of sulfolane, 12.0 percent by weight of butyl carbitol, 2.0 percent by weight of ammonium bromide, 13.0 percent by weight of acetylethanolamine, 0.03 percent by weight of ammonium hydroxide, 0.05 percent by weight of DOWICIL 150 biocide, obtained from Dow Chemical Company, Midland, Mich., 0.05 percent by weight of polyethylene oxide (molecular weight 18,500), obtained from Union Carbide Company, 25 percent by weight of Projet Magenta 1T dye solution, obtained from Zenca Colors, 6.0 percent by weight of Acid Red 52 solution obtained from Triton Colors, and 26.12 percent by weight of deionized water.

Yellow:

15.75 percent by weight of sulfolane, 12.0 percent by weight of butyl carbitol, 13.0 percent by weight of acetylethanolamine, 2.0 percent by weight of ammonium bromide, 0.03 percent by weight of ammonium hydroxide, 0.05 percent by weight of DOWICIL 150 biocide, obtained from Dow Chemical Company, Midland, Mich., 0.05 percent by weight of polyethylene oxide (molecular weight 18,500), obtained from Union Carbide Company, 27.0 percent by weight of Projet Yellow 1G dye (7.5 percent solution), obtained from Zenca Colors, 20.0 percent by weight of Acid Yellow 17 solution obtained from Triton Colors, and 10.12 percent by weight of deionized water.

Black:

Twenty percent by weight of sulfolane, 6.0 percent by weight of trimethylolpropane, 1.25 percent by weight of ammonium formate, 0.05 percent by weight of DOWICIL 150 biocide, obtained from Dow Chemical Company, Midland, Mich., 0.05 percent by weight of polyethylene oxide (molecular weight 18,500), obtained from Union Carbide Company, 17.0 percent by weight of Basacid Black NB X 34, obtained from BASF, 3.0 percent by weight of Direct Red 227, obtained from Tricon Colors, and 52.65 percent by weight of deionized water.

Images were generated by printing block patterns for magenta, cyan, yellow, and black. The images thus formed were dried by exposure to microwave radiation with a Citizen Model No. JM55581, obtained from Consumers, Mississauga, Ontario, Canada, set at 700 watts output power at 2450 MHz frequency. The resulting images dried in less than 10 seconds and yielded optical density values of 2.00 black, 1.90 cyan, 1.65 magenta and 1.00 yellow. Due to primarily the desired spot sizes of colored and black inks, there were no white streaks in the images. These images had lightfastness values better than 90 percent and, more specifically, about 95 percent average for all colors after a period of six months, and showed no intercolor bleed when retained at a 80 percent humidity at 80° F. for a period of seven days.

EXAMPLE V

Twenty transparency sheets were prepared by the solvent extrusion process (single side each time initially) on a Faustel Coater using a two slot die by providing for each a MYLAR™ base sheet (roll form) with a thickness of 100 microns, and coating the base sheet simultaneously with two hydrophilic polymeric layers, 10 microns in total thickness, layer in contact with the substrate and comprised of a blend comprised of 50 parts of the super absorbent poly(dimethyl acrylamide-acrylosarcosine methyl ester), #15776 available from Poly Sciences Inc., 49 parts by weight of a second ink absorber of hydroxyethyl methyl cellulose (HEM available from British Celanese Ltd.), and 1 part by weight of the biocide compound 2-hydroxypropylmethane thiosulfonate (Busan 1005 available from Buckman Laboratories Inc.), which blend was present in a concentration of 5 percent by weight in water, and a second 5 micron thick ink coating layer situated on the top of the 10 micron thick first layer and comprised of 50 parts by weight of polyvinyl alcohol, 88 percent hydrolyzed, available as Airvol 540-S from Air Products Company, 20 percent by weight of 3,5-dihydroxy benzoic acid (Aldrich #D11,000-0), and 24.9 parts by weight of the dye mordant polymethyl acrylate trimethyl ammonium chloride, HX42-1 available from Interpolymer Corporation, 3.0 parts by weight of poly[N,N -bis(2,2,6,6-tetramethyl-4-piperidinyl)-1,6-hexanediamine-co-2,4-dichloro-6-morpholino-1,3,5-triazine) (Cyasorb UV-3346, #41,324-0, available from Aldrich Chemical Company), and 2.0 parts by weight of didodecyl 3,3'-thiodipropionate, and 0.1 part by weight of colloidal silica filler, available as Syloid 74 from W.R. Grace and Company, which blend was present in a concentration of 4 percent by weight in water. Subsequent to air drying at 100° C. and monitoring the difference in weight prior to and subsequent to coating, the dried MYLAR™ base sheet rolls contained 1.5 grams in a thickness of 15 microns of the two layered transparency structure. Rewinding the coated side of the MYLAR™ base sheet (roll form) on to an empty core and using these rolls, the uncoated side of the MYLAR™ base sheet was coated on a Faustel Coater using a two slot die simultaneously with two hydrophilic polymeric layers where the first layer in contact with the substrate was comprised of a blend of 50 parts of the super absorbent poly(dimethyl acrylamide-acrylosarcosine methyl ester), #15776 available from Poly Sciences Inc., 49 parts by weight of a second ink absorber hydroxyethyl methyl cellulose (HEM available from British Celanese Ltd.), and 1 part by weight of the biocide compound 2-hydroxypropylmethane thiosulfonate (Busan 1005 available from Buckman Laboratories Inc.), which blend was present in a concentration of 5 percent by weight in water, and a second 5 micron thick ink coating layer situated on the top of the 10 micron thick first layer and comprised of 50 parts by weight of polyvinyl alcohol, 88 percent hydrolyzed, available as Airvol 540-S from Air Products Company, 20 parts by weight of 3,5-dihydroxy benzoic acid (Aldrich #D11,000-0), and 24.9 parts by weight of a dye mordant polymethyl acrylate trimethyl ammonium chloride, HX42-1 available from Interpolymer Corporation, 3.0 parts by weight of poly[N,N-bis(2,2,6,6-tetramethyl-4-piperidinyl)-1,6-hexanediamine-co-2,4-dichloro-6-morpholino-1,3,5-triazine] (Cyasorb UV-3346, #41,324-0, available from Aldrich Chemical Company), and 2.0 parts by weight of didodecyl 3,3'-thiodipropionate, and 0.1 part by weight of colloidal silica, available as Syloid 74 from W.R. Grace and Company, which blend was present in a concentration of 4 percent by weight in water. Subsequent to air drying at 100° C. and monitoring the difference in weight prior to and subsequent to coating, the dried MYLAR™ base sheet rolls contained 1.5 grams in a thickness of 15 microns of the two layered transparency structure. The transparency sheets thus prepared had a haze value of 3.

The above prepared transparencies were incorporated into a Hewlett-Packard 500-C color ink jet printer containing inks of the following compositions:

Cyan:

15.75 percent by weight of sulfolane, 12.0 percent by weight of butyl carbitol, 2.0 percent by weight of ammonium bromide, 13.0 percent by weight of acetylethanolamine, 0.015 percent by weight of ammonium hydroxide, 0.05 percent by weight of polyethylene oxide (molecular weight 18,500), obtained from Union Carbide Company, 22.5 percent by weight of Projet Cyan 1 dye solution, obtained from Zenca Colors, 18.75 percent by weight of Projet Blue OAM dye solution, obtained from Zenca Colors, and 15.935 percent by weight of deionized water.

Magenta:

15.75 percent by weight of sulfolane, 12.0 percent by weight of butyl carbitol, 2.0 percent by weight of ammonium bromide, 13.0 percent by weight of acetylethanolamine, 0.03 percent by weight of ammonium hydroxide, 0.05 percent by weight of DOWICIL 150 biocide, obtained from Dow Chemical Company, Midland, Mich., 0.05 percent by weight of polyethylene oxide (molecular weight 18,500), obtained from Union Carbide Company, 25 percent by weight of Projet Magenta 1T dye solution, obtained from Zenca Colors, 6.0 percent by weight of Acid Red 52 solution obtained from Tricon Colors, and 26.12 percent by weight of deionized water.

Yellow:

15.75 percent by weight of sulfolane, 12.0 percent by weight of butyl carbitol, 13.0 percent by weight of acetylethanolamine, 2.0 percent by weight of ammonium bromide, 0.03 percent by weight of ammonium hydroxide, 0.05 percent by weight of DOWICIL 150 biocide, obtained from Dow Chemical Company, Midland, Mich., 0.05 percent by weight of polyethylene oxide (molecular weight 18,500), obtained from Union Carbide Company, 27.0 percent by weight of Projet Yellow 1G dye (7.5 percent solution), obtained from Zeneca Colors, 20.0 percent by weight of Acid Yellow 17 solution obtained from Tricon Colors, and 10.12 percent by weight of deionized water.

Black:

Twenty percent by weight of sulfolane, 6.0 percent by weight of trimethylolpropane, 1.25 percent by weight of ammonium formate, 0.05 percent by weight of DOWICIL 150 biocide, obtained from Dow Chemical Company, Midland, Mich., 0.05 percent by weight of polyethylene oxide (molecular weight 18,500), obtained from Union Carbide Company, 17.0 percent by weight of Basacid Black NB X 34 obtained from BASF, 3.0 percent by weight of Direct Red 227 obtained from Tricon Colors, and 52.65 percent by weight of deionized water.

Images were generated by printing block patterns for magenta, cyan, yellow, and black. The images thus formed were dried by exposure to microwave radiation with a Citizen Model No. JM55581, obtained from Consumers, Mississauga, Ontario, Canada, set at 700 watts output power at 2450 MHz frequency. The resulting images dried in less than 10 seconds and yielded optical density values of 2.00 black, 1.80 cyan, 1.60 magenta and 1.00 yellow. With these spot sizes of colored and black inks, there were no white streaks in the images. These images had lightfastness values of greater than 90 percent and, more specifically, about 98 percent average for all colors after a period of six months, and showed no intercolor bleed when retained at an 80 percent humidity at 80° F. for a period of seven days.

In a comparative study, Hewlett Packard Desk Jet Transparency 51636 F printed with a 550-C printer containing Hewlett Packard inks had a lightfastness value of 17 percent for magenta, 83 percent for yellow, and 4 percent for cyan after 50 hours in a UV fadometer (equivalent to two months of sunshine). Hewlett Packard Desk Jet Transparency 51636 F with an ink receiving layer of 5 to 6 microns has a haze value of 7 percent. When the ink receiving layer is 10, 15, or 20 microns thick, the haze values were substantially higher at 10.2, 13.8, or 16.9, respectively. These values were measured from the transmittance data obtained on sandwiches prepared with two, three, and four transparencies.

Other embodiments and modifications of the present invention may occur to those skilled in the art subsequent to a review of the information presented herein; these embodiments and modifications, as well as equivalents thereof, are also included within the scope of this invention.

What is claimed is:

1. A transparency comprised of a supporting substrate, thereover a first coating layer comprised of at least one ink absorbing polymer layer and a biocide; and a second ink coating layer comprised of a hydrophilic vinyl binder, a waterfastness dye mordant, a filler, an optional lightfastness inducing agent, an optional biocide, and an ink spot size increasing agent selected from the group consisting of hydroxy acids, amino acids and polycarboxyl acids; and wherein the first coating is in contact with the substrate and is situated between the substrate and the second ink coating.

2. A transparency in accordance with claim 1 wherein the absorbing polymer is selected from the group consisting of (1) acrylamide-acrylic acid copolymers, (2) poly (acrylamide), (3) polyacrylate salts, (4) poly(N,N-dimethyl acrylamide), and (5) poly(dimethyl acrylamide-acrylosarcosine methyl ester).

3. A transparency in accordance with claim 1 wherein the absorbing polymer is a water soluble polymer binder selected from the group consisting of (1) starch, (2) cationic starch, (3) hydroxypropyl starch, (4) hydroxyethyl starch, (5) gelatin, (6) methyl cellulose, (7) benzyl cellulose, (8) phenyl cellulose, (9) hydroxyethyl cellulose, (10) hydroxypropyl cellulose, (11) ethyl hydroxyethyl cellulose, (12) hydroxyethyl methyl cellulose, (13) hydroxypropyl methyl cellulose, (14) hydroxybutyl methyl cellulose, (15) dihydroxypropyl cellulose, (16) hydroxypropyl hydroxyethyl cellulose, (17) chlorodeoxycellulose, (18) amino deoxycellulose, (19) diethylammonium chloride hydroxyethyl cellulose, (20) hydroxypropyl trimethyl ammonium chloride hydroxyethyl cellulose, (21) diethylaminoethyl cellulose, (22) carboxymethyl dextrans, (23) diethyl aminoethyl dextran, (24) amino dextran, (25) sodium carboxymethyl cellulose, (26) gum arabic, (27) carrageenan, (28) karaya gum, (29) xanthan, (30) chitosan, (31) carboxymethyl hydroxypropyl guar, (32) cationic guar, (33) n-carboxymethyl chitin, (34) dimethyl ammonium hydrolyzed collagen protein, (35) agar-agar, (36) sodium cellulose sulfate, (37) sodium carboxymethylhydroxyethyl cellulose, (38) poly(ethylene oxide), (39) ethylene oxide/propylene oxide copolymers, (40) ethylene oxide/2-hydroxyethyl methacrylate/ethyleneoxide, (41) ethylene oxide/hydroxypropyl methacrylate/ethylene oxide triblock copolymers, (42) ionene/ethylene oxide/ionene triblock copolymers, (43) ethylene oxide/isoprene/ethylene oxide triblock copolymers, and (44) an epichlorohydrin-ethylene oxide copolymer.

4. A transparency in accordance with claim 1 wherein the absorbing polymer is present in an amount of from about 25 parts to about 75 parts by weight, and there is further included a second absorbing polymer binder in an amount of from about 75 parts to about 25 parts by weight.

5. A transparency in accordance with claim 1 wherein the thickness of the first ink absorbing coating layer in contact with the substrate is from about 0.1 to about 25 microns.

6. A transparency in accordance with claim 1 wherein said hydrophilic vinyl binder of the second ink layer is comprised of (1) poly(vinyl alcohol), (2) poly(vinyl phosphate), (3) poly(vinyl pyrrolidone), (4) vinyl pyrrolidone-vinyl acetate copolymers, (5) vinyl pyrrolidone-styrene copolymers, (6) poly(vinylamine), (7) poly(vinyl alcohol) alkoxylated, or (8) poly(vinyl pyrrolidone-diethylaminomethylmethacrylate).

7. A transparency in accordance with claim 1 wherein said amino acids are selected from the group consisting of alanine, 2-aminobutyric acid, norvaline, norleucine, 2-amino caprylic acid, 2-phenyl glycine, phenyl alanine, homophenyl alanine, serine, cysteine, cysteic acid monohydrate, homocysteic acid, leucine, tyrosine, cystine, aspartic acid, leucenol, acetyl-lysine, tryptophan, trityl-L-cysteine, 1-methyl tryptophan, histidine, 4-amino phenylalanine hydrate, glutamic acid, glutamine, γ-glutamyl-glutamic acid, N-(γ-glutamyl) phenylalanine, asparagine, citrulline, ethionine, lysine, lysine hydrate, 3-(3,4-dihydroxy phenyl)-alanine, 2-amino-4-pentanoic acid, 2-amino-4-sulfamoyl butyric acid, arginine, carbobenzyl-tyrosine, carbamyl'-cysteine, N-∈(tert-butoxy carbonyl)-lysine, (tert butylthio)-cysteine, γ-carboxy glutamic acid, N-carbobenzyloxy-lysine, carboxymethyl-cysteine, methionine, methionine sulfoxide, methionine sulfoximine, homoserine, homocysteine, 3-(2-thiazolyl)-alanine, glycyl glycyl tyrosine dihydrate, glycyl-glutamic acid, threonine, valine, isoleucine, 4-hydroxy phenyl glycine, 3-hydroxynorvaline, N-acetyl-glutamic acid, N-acetyl-methionine, N-α-acetyl-histidine monohydrate, N-acetyl-tryptophan, N-acetyl-cysteine, N-acetyl-phenylalanine, N-acetyl-penicillamine, 2-aminobutyric acid, α-methyl tyrosine, 3-(3,4-dihydroxyphenyl)-2-methyl-alanine sesquihydrate, α-methyl-phenylalanine, alanyl-norvaline, alanyl-phenyl alanine, N-(tert-butoxy carbonyl)-isoleucine, N-α-(tert butoxy carbonyl)-lysine, N-(tert-butoxy carbonyl)-phenylalanine, N-(tert-butoxy carbonyl)-serine, N-(tert-butoxy carbonyl)-threonine, N-(tert-butoxy carbonyl)- valine, carbobenzyloxy-alanine, N-carbobenzyloxy-arginine, carbobenzyloxy-asparagine, N-carbobenzyloxy-aspartic acid, carbobenzyloxy-glutamine, N-(carbobenzyloxy)-lysine, N-(carbobenzyloxy)-phenylalanine, carbobenzyloxy-serine, and carbobenzyloxy-valine.

8. A transparency in accordance with claim 1 wherein said amino acids are an amino acid salt selected from the group consisting of 2,3-diamino propionic acid monohydrochloride, 2,3-diamino propionic acid monohydrobromide, ornithine hydrochloride, homoarginine hydrochloride, arginine hydrochloride, 2,4-diaminobutyric acid dihydrochloride, lysine monohydrochloride, lysine dihydrochloride, β-methyl-phenyl alanine hydrochloride, 2-methylornithine hydrochloride monohydrate, glycine, glycine hydrochloride, β-alanine, 4-aminobutyric acid, 5-aminovaleric acid, 5-aminovaleric acid hydrochloride, 6-amino caproic acid, 7-aminoheptanoic acid, 8-amino caprylic acid, 11-amino undecanoic acid, 12-amino dodecanoic acid, amino benzoic acid, 3-amino benzoic acid hydrochloride, 4-amino phenyl acetic acid, 4-amino methyl benzoic acid, 5-amino-2-methyl benzoic acid, 2-amino-4,5-dimethoxy benzoic acid, 4-amino methyl cyclohexane carboxylic acid, 5-amino sailcyclic acid, 3,5-diaminobenzoic acid, 4-aminohippuric acid, glycyl glycine, N-(4-aminobenzoyl)-β-alanine, N-(4-aminobenzoyl)-6-aminocaproic acid, 5-amino isophthalic acid, 1-amino-1-cyclopentane carboxylic acid, 1-amino-1-cyclopropane carboxylic acid hemihydrate, 1-amino-1-cyclopropane carboxylic acid hydrochloride, 4-amino cinnamic acid hydrochloride, succinamic acid, carboxymethoxylamine hemihydrochloride, 2-hydrazino benzoic acid hydrochloride, allantoic acid, 2-aminobenzophenone-2'-carboxylic acid, and creatine monohydrate.

9. A transparency in accordance with claim 1 wherein the acid is n-trityl glycine, 2-acetamido acrylic acid, 4-acetamido benzoic acid, α-acetamido cinnamic acid, 6-acetamido hexanoic acid, acetamido acetic acid, N-(2-mercapto propionyl) glycine, amino methane sulfonic acid, α-2-aminoethane sulfonic acid, 3-amino-1-propane sulfonic acid, 2-amino ethyl hydrogen sulfate, sulfanilic acid, 2-amino-1-naphthalene sulfonic acid, 2,5-diamino benzene sulfonic acid, N-(2-acetamido) 2-amino ethane sulfonic acid, 2-amino ethyl dihydrogen phosphate, 2-aminoethyl phosphonic acid, 3-aminopropyl phosphonic acid, or 4-amino phenyl phosphonic acid.

10. A transparency in accordance with claim 1 wherein the hydroxy acids of the second layer are selected from the group consisting of glycolic acid, 10-hydroxydecanoic acid, 12-hydroxydodecanenoic acid, 16-hydroxy hexadecanoic acid, 1-hydroxy-1-cyclopropane carboxylic acid, hydroxy benzoic acid, 3-hydroxy-4-methoxy benzoic acid, 4-hydroxy-3-methoxy benzoic acid, 4-hydroxy-3,5-dimethoxy benzoic acid, 3-hydroxy-4,5-dimethoxy benzoic acid, 2-hydroxy-3-isopropyl-6-methyl benzoic acid, 2-hydroxy-6-isopropyl-3-methyl benzoic acid, hydroxy cinnamic acid, 3-hydroxy-4-methoxy cinnamic acid, 4-hydroxy-3-methoxy cinnamic acid, 3,5-dimethoxy-4-hydroxy cinnamic acid, 2-hydroxyhippuric acid, hydroxy phenyl acetic acid, 4-hydroxy-3-methoxy phenyl acetic acid, 3-(4 hydroxyphenyl) lactic acid hydrate, 4-hydroxyphenyl pyruvic acid, 4-hydroxy benzene sulfonic acid, and 3[(1,1-dimethyl-2-hydroxyethyl) amino]-2-hydroxy propane sulfonic acid.

11. A transparency in accordance with claim 1 wherein the hydroxy acids of the second layer are selected from the group consisting of lactic acid, 3-hydroxybutyric acid, 2-hydroxyisobutyric acid, 2-ethyl-2 hydroxybutyric acid, 2-hydroxy-3-methyl butyric acid, 2-hydroxy-2-methyl butyric acid, 2-hydroxy caproic acid, hydroxyisocaproic acid, mandelic acid, 4-methoxy mandelic acid, 4-bromo mandelic acid, 3-hydroxy-4-methoxy mandelic acid, 4-hydroxy-3-methoxy mandelic acid, 4-hydroxy mandelic acid monohydrate, 3-chloro-4-hydroxy benzoic acid hemihydrate, 2-hydroxy-3-isopropyl benzoic acid, 3,5-dibromohydroxy benzoic acid, 3,5-dichloro hydroxy benzoic acid, benzilic acid, 2-(4-hydroxy phenoxy) propionic acid, α-hydroxy hippuric acid, 3,5-diisopropyl salicylic acid, 3-chloro-4-hydroxy phenyl acetic acid, 12-hydroxystearic acid, tropic acid, 2-acrylamido glycolic acid monohydrate, and hexahydromandelic acid.

12. A transparency in accordance with claim 1 wherein the hydroxy acids of the second layer are selected from the group consisting of dihydroxy benzoic acid, 3,4-dihydroxy cinnamic acid, 3,4-dihydroxy hydro cinnamic acid, 3,4-dihydroxy mandelic acid, 3,5-dihydroxy-4-methyl benzoic acid hemihydrate, dihydroxy naphthoic acid, dihydroxy phenylacetic acid, bicine, 2,2-bis(hydroxymethyl)propionic acid, 4,4-bis(4-hydroxyphenyl) valeric acid, and tris (hydroxymethyl) amino methane succinate.

13. A transparency in accordance with claim 1 wherein said polycarboxyl acids are selected from the group consisting of oxalic acid, malonic acid, succinic acid, glutaric acid, adipic acid, pimelic acid, suberic acid, azelaic acid, sebacic acid, undecanedioic acid, 1,10-decane dicarboxylic acid, 1,11-undecane dicarboxylic acid, 1,12-dodecane dicarboxylic acid, hexadecanedioic acid, tetracosane dioic acid, methyl malonic acid, ketomalonic acid monohydrate, ethyl malonic acid, diethyl malonic acid, mercapto succinic acid, methyl succinic acid, malic acid, 2,3-dimethyl succinic acid, citramalic acid, cyclohexyl succinic acid, 2-(carboxymethyl thio) succinic acid, tartaric acid, 2,2-dimethyl glutaric acid, 2,4-dimethyl glutaric acid, 3,3-dimethyl glutaric acid, 2-methyl glutaric acid, 3-methyl glutaric acid, 3,3-tetramethylene glutaric acid, 3-phenyl glutaric acid, 2-ketoglutaric acid, 3-ketoglutaric acid, 3-methyl adipic acid, 2,6-diamino pimelic acid, 4-ketopimelic acid, mucic acid, 3-methylene cyclopropane-trans-1,2-dicarboxylic acid, 1,1-cyclobutane dicarboxylic acid, cyclohexane dicarboxylic acid, imino diacetic acid, [N-(2-acetamido) imino diacetic acid], methyl iminodiacetic acid, diglycolic acid, 1,1-cyclohexane diacetic acid, fumaric acid, maleic acid, glutaconic acid, 2-dodecenedioic acid, mesaconic acid, citraconic acid, dihydroxy fumaric acid hydrate, trans, and trans-1,3-butadiene-1,4-dicarboxylic acid.

14. A transparency in accordance with claim 1 wherein said polycarboxyl acids are selected from the group consisting of homophthalic acid, terephthalic acid, phthalic acid, 4-methyl phthalic acid, chelidonic acid monohydrate, chelidamic acid monohydrate, cis-5-norbornene-endo-2,3-dicarboxylic acid, 1,4-naphthalene dicarboxylic acid, 2,3-naphthalene dicarboxylic acid, 2,6-naphthalene dicarboxylic acid, 4-carboxy phenoxy acetic acid, 2,5-dihydroxy-1,4-benzene diacetic acid, pamoic acid, 4-[4-(2-carboxybenzoyl)phenyl]butyric acid, 1,4-phenylene diacrylic acid, 2-carboxy cinnamic acid, γ-glutamyl-L-cysteinyl glycine, isocitriclactone [2-oxotetrahydrofuran-4,5-dicarboxylic acid], N-(2-hydroxyethyl) iminodiacetic acid, dipivaloyl-tartaric acid, cyclohexyl succinic acid, phenyl diacetic acid, 1,3,5-cyclohexane tricarboxylic acid, citric acid monohydrate, 1,2,3-propene tricarboxylic acid, 1,2,3-propane tricarboxylic acid, β-methyl tricarballyic acid, 1,2,3,4-cyclobutane tetracarboxylic acid, 1,2-diaminocyclohexane-N,N,N'N'-tetraacetic acid hydrate, 1,6-diaminohexane-N,N,N'N'-tetraacetic acid hydrate, 1,2,4,5-benzene tetracarboxylic acid, 1,4,5,8-naphthalene tetracarboxylic acid hydrate, penta diethylene triamine penta acetic acid, mellitic acid, agaricic acid, 1-2-diamino propane-N,N,N',N'-tetraacetic acid, ethylene diamine tetraacetic acid, 2-(caraboxymethylthio) succinic acid, N-(2-hydroxyethyl) ethylene diamine triacetic acid, N,N'-bis(2-carboxyethyl)-N,N'-ethylene diglycine trihydrate, and tetrahydrofuran-2,3,4,5-tetracarboxylic acid.

15. A transparency in accordance with claim 1 wherein the lightfastness inducing agent is present and is selected from the group consisting of (1) glycerol ρ-amino benzoate, (2) resorcinol mono benzoate, (3) octyl dimethyl amino benzoate, (4) hexadecyl 3,5-di-tert-butyl-4-hydroxybenzoate, (5) octyl salicylate, (6) octyl methoxy cinnamate, (7) 4-allyloxy-2-hydroxybenzophenone, (8) 2-hydroxy-4-methoxy benzophenone, (9) 2,2'-dihydroxy-4,4'-dimethoxy benzophenone, (10) 2-hydroxy-4-(octyloxy)benzophenone, (11) 2-hydroxy-4-dodecyloxy benzophenone, (12) 2-(2'-hydroxy-S'-methylphenyl)benzotriazole, (13) 2-[2'-hydroxy-3,5-di-(1,1-dimethyl benzyl)phenyl]-2H-benzotriazole, (14) bis[2-hydroxy-5-tert-octyl-3-(benzotriazol-2-yl) phenyl methane], (15) 2-(3', 5'-di-tert-butyl-2'-hydroxyphenyl)-5-chlorobenzotriazole, (16) 2-(4-benzoyl-3-hydroxyphenoxy)ethylacrylate, (17) poly[2-(4-benzoyl-3-hydroxyphenoxy)ethylacrylate], (18) N-(ρ-ethoxycarbonyl phenyl)-N'-ethyl-N'-phenyl formadine, (19) 1,1-(1,2-ethane-diyl) bis(3,3,5,S-tetramethyl piperazinone), (20) tris(3,5-di-tert-butyl-4-hydroxybenzyl)isocyanurate, (21 ) nickel bis(o-ethyl(3,5-di-tert-butyl-4-hydroxybenzyl) phosphonate), (22) [2,2,6,6-tetramethyl-4-piperidinyl)-1,2,3,4-butane tetracarboxylate], (23) [2,2,6,6-tetramethyl-4-piperidinyl/β,β,β',β'-tetramethyl-3,9(2,4,8,10-tetraoxospiro (5,5) undecane)diethyl]-1,2,3,4-butane tetracarboxylate, (24) [1,2,2,6,6-pentamethyl-4-piperidinyl/β,β,β',β'-tetramethyl-3,9-(2,4,8, 10-tetraoxospiro (5,5) undecane) diethyl]-1,2,3,4-butane tetracarboxylate, (25) 2-dodecyl-N-(2,2,6,6-tetramethyl-4-piperidinyl) succinimide, (26) 2-dodecyl -N-(1,2,2,6,6-pentamethyl-4-piperidinyl) succinimide, (27) N-(1-acetyl -2,2,6,6-tetramethyl-4-piperidinyl)-2-dodecyl succinimide, (28) tetra sodium N-(1,2-dicarboxyethyl)-N -octadecyl sulfosuccinamate, (29) nickel dibutyldithiocarbamate, (30) poly(4-hydroxy-2,2,6,6-tetramethyl-1-piperidine ethanol/dimethyl succinic acid), (31) poly(3,5-di-tert-butyl-4-hydroxy hydrocinnamic acid ester)/1,3,5-tris(2-hydroxyethyl)-5-triazine -2,4,6(1H,3H,5H)-trione, (32) poly[N,N-bis(2,2,6,6-tetramethyl-4-piperidinyl) -1,6-hexanediamine-co-2,4-dichloro-6-morpholino-1,3,5-triazine], (33) 1-[N -[poly(3-allyloxy-2-hydroxypropyl)-2-aminoethyl]-2-imidazolidinone], and (34) poly(2-ethyl-2-oxazoline).

16. A transparency in accordance with claim 1 wherein in the dye mordant is a quaternary acrylic copolymer of the formula

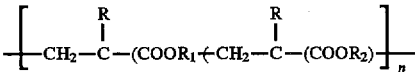

wherein n is a number of from about 10 to about 100, R is hydrogen or methyl, $R_1$ is hydrogen, an alkyl group, or an aryl group, and $R_2$ is $N^+(CH_3)_3X^-$, wherein X is an anion, and the degree of quaternization is from about 1 to about 100 percent.

17. A transparency according to claim 1 wherein the dye mordant is a monoammonium compound selected from the group consisting of (1) tetramethyl ammonium bromide, (2) tetrahexyl ammonium hydrogen sulfate, (3) hexamethylene bistrimethyl ammonium bromide, (4) 2-hydroxypropyl-bis-1,3-(N-isostearyl amido propyl-N,N-dimethyl ammonium chloride), (5) ricinoleamidopropyl ethyl dimonium ethosulfate, (6) benzyl tallow dimethyl ammonium chloride, or (7) myristyl trimethyl ammonium bromide.

18. A transparency according to claim 1 wherein the dye mordant is a phosphonium compound selected from the group consisting of (1) methyl triphenyl phosphonium bromide, (2) n-propyl triphenyl phosphonium bromide, (3) cyclopropyl triphenyl phosphonium bromide, (4) hexadecyl tributyl phosphonium bromide, (5) stearyl tributyl phosphonium bromide, (6) tetramethyl phosphonium chloride, (7) tetraethyl phosphonium chloride, and (8) tetrabutyl phosphonium chloride.

19. A transparency in accordance with claim 1 wherein the filler is selected from the group consisting of (1) microspheres of sodium borosilicate glass, (2) microspheres of soda lime glass, (3) microspheres of phenolic polymers, (4) vinylidene chloride-acrylonitrile microspheres, (5) hollow composite microspheres of polyvinylidene chloride/acrylonitrile copolymer shell, 15 percent by weight, and calcium carbonate, 85 percent by weight, (6) stearate coated calcium carbonate, (7) sodium metasilicate anhydrous, (8) sodium metasilicate pentahydrate, (9) organophilic montmorillonitrile clay, (10) magnesium aluminum silicate, (11) magnesium carbonate, (12) magnesium oxide, (13) zirconium oxide, (14) colloidal silicas, (15) titanium dioxide, (16) hydrated alumina, (17) barium sulfate, (18) calcium carbonate, (19) high brightness clays, (20) calcium silicate, (21) blends of calcium fluoride and silica, (22) zinc oxide, (23) blends of zinc sulfide with barium sulfate, (24) barium titanate, (25) brightener fluorescent pigments of coumarin derivatives, (26) fluorescent pigments of oxazole derivatives, (27) antimony oxide, and mixtures thereof.

20. A transparency in accordance with claim 1 wherein the thickness of the second coating layer in contact with the first coating layer is from about 0.1 to about 25 microns, and wherein said transparency possesses a haze value of from about 0.5 to about 10.

21. A transparency in accordance with claim 1 wherein the vinyl polymer or mixtures thereof are present in amounts of from about 20 parts by weight to about 97 parts by weight, the ink spot size increasing agent is present in amounts of from about 40 parts by weight to about 1 part by weight, the waterfastness dye mordant is present in amounts of from about 25 parts by weight to about 1.8 parts by weight, the lightfastness inducing agent is present in amounts of from about 10 parts by weight to about 0.1 part by weight, the filler is present in amounts of from about 5 parts by weight to about 0.1 part by weight, and which transparency possesses a haze value of from about 0.5 to about 6 and a lightfastness value of greater than 95.

22. A transparency in accordance with claim 1 wherein the thickness of the first coating is from about 2 to about 10 microns, and the thickness of the second coating is from about 5 to about 15 microns.

23. A transparency in accordance with claim 1 wherein the haze value is from about 0.5 to about 5.

24. A transparency in accordance with claim 1 wherein the lightfastness value is from about 80 to about 86 percent.

25. A transparency in accordance with claim 1 wherein the substrate is selected from the group consisting of (1) polyesters, (2) polyethylene naphthalates, (3) polycarbonates, (4) polysulfones, (5) polyether sulfones, (6) poly(arylene sulfones), (7) cellulose triacetate, (8) polyvinyl chloride, (9) cellophane, (10) polyvinyl fluoride, (11) polypropylene, and (12) polyimides.

26. A transparency in accordance with claim 1 with a haze value of from about 0.5 to about 10, and a lightfastness value of from about 95 to about 98.

27. A transparency in accordance with claim 1 wherein two absorbing polymers are selected.

28. A transparency comprised of a supporting substrate, thereover and thereunder a first coating layer comprised of an ink absorbent binder two polymer mixture with excellent adherence to the substrate, and wherein the first polymer of the mixture is present in amounts of from about 24 parts by weight to about 75 parts by weight, and the second polymer of the mixture is present in amounts of from about 75 parts by weight to about 24 parts by weight, and a biocide is present in an amount of about 1 part by weight; and a second polyvinyl alcohol ink receiving layer containing hydroxy acids, amino acids, or polycarboxylic compounds, and waterfastness dye mordant of cationic quaternary compounds, said waterfastness mordant being present in amounts of from about 25 parts by weight to about 1.9 parts by weight, and a filler present in amounts of from about 5 parts by weight to about 0.1 part by weight, and wherein the first coating is in contact with the substrate and is situated between the substrate and said second ink receiving layer, and which transparency possesses a haze value of from about 0.5 to about 6 and a lightfastness value of about 95.

29. A transparency comprised of a polyethylene terephthalate substrate, thereover and thereunder a first coating layer comprised of a blend of super absorbent acrylic acid-acrylamide copolymer and hydroxyethyl methyl cellulose, and a biocide of 2-hydroxypropylmethane thiosulfonate, and a second coating layer comprised of a blend of polyvinyl alcohol, 3,5-dihydroxy benzoic acid, a dye mordant of polymethyl acrylate trimethyl ammonium chloride, and a filler is colloidal silica.

30. A transparency in accordance with claim 29 wherein the acrylic acid-acrylamide copolymer is present in an amount of 50 parts by weight, the hydroxyethyl methyl cellulose is present in an amount of 49 parts by weight, 2-hydroxypropylmethane thiosulfonate is present in an amount of 1 part by weight, polyvinyl alcohol is present in an amount of 55 parts by weight, 3,5-dihydroxy benzoic acid is present in an amount of 20 parts by weight, polymethyl acrylate trimethyl ammonium chloride is present in an amount of 24.9 parts by weight, and colloidal silica is present in an amount of 0.1 part by weight.

31. A transparency in accordance with claim 28 with a haze value of 3.2.

* * * * *